US009493263B2

(12) United States Patent
Jones et al.

(10) Patent No.: US 9,493,263 B2
(45) Date of Patent: Nov. 15, 2016

(54) SYSTEM AND METHOD FOR UNWRAPPING ROUND MODULES

(71) Applicants: Malcom Lee Jones, Amarillo, TX (US); Larren Michael Jones, Nazareth, TX (US)

(72) Inventors: Malcom Lee Jones, Amarillo, TX (US); Larren Michael Jones, Nazareth, TX (US)

( * ) Notice: Subject to any disclaimer, the term of this patent is extended or adjusted under 35 U.S.C. 154(b) by 464 days.

(21) Appl. No.: 13/844,503

(22) Filed: Mar. 15, 2013

(65) Prior Publication Data

US 2013/0216342 A1 Aug. 22, 2013

Related U.S. Application Data

(63) Continuation-in-part of application No. 12/846,045, filed on Jul. 29, 2010, now Pat. No. 8,714,902.

(51) Int. Cl.
*B65B 69/00* (2006.01)

(52) U.S. Cl.
CPC ..... *B65B 69/0025* (2013.01); *B65B 69/0033* (2013.01)

(58) Field of Classification Search
CPC ..... B65B 49/14; B65B 51/04; B65B 27/12; B65B 27/125; B65B 69/0025; B65B 69/0033; B65B 69/0008; B65B 69/00; B65B 5/045; B65B 11/48; B29C 65/76; B29C 66/1122; B29C 66/3432; B29C 66/344; B29C 7/064; A24C 5/36
See application file for complete search history.

(56) References Cited

U.S. PATENT DOCUMENTS

| | | | | |
|---|---|---|---|---|
| 4,044,907 | A * | 8/1977 | Craft | 414/24.5 |
| 4,549,840 | A * | 10/1985 | Ansbjer | 414/24.5 |
| 4,929,141 | A * | 5/1990 | Keesey et al. | 414/412 |
| 5,081,727 | A * | 1/1992 | Ippolito | 5/419 |
| 5,179,878 | A * | 1/1993 | Kranefeld et al. | 83/13 |
| 5,371,938 | A * | 12/1994 | Martin | 29/564.3 |
| 5,442,895 | A * | 8/1995 | Linson | 53/381.2 |
| 5,505,406 | A * | 4/1996 | Summey, III | 242/563.1 |
| 5,586,350 | A * | 12/1996 | Thonnessen et al. | 5/636 |
| 6,537,008 | B1 * | 3/2003 | Haring | 414/24.5 |
| 2009/0202327 | A1 * | 8/2009 | Cory et al. | 414/412 |
| 2011/0197552 | A1 | 8/2011 | Jones et al. | |

FOREIGN PATENT DOCUMENTS

| | | | |
|---|---|---|---|
| JP | 2004314549 | A * | 11/2004 |
| JP | 3166765 | U * | 3/2011 |

* cited by examiner

*Primary Examiner* — Glenn Myers
(74) *Attorney, Agent, or Firm* — Shannon L Warren

(57) ABSTRACT

A round module unwrapping method is disclosed. Said round module unwrapping method comprising: supporting one or more round modules on a module feeder floor of a round module unwrapping system, detaching a first flap from a second flap of a module wrapper of said round modules, and pulling said second flap of said module wrapper. Said round module unwrapping system comprises a module feeder floor, a first side and a second side. Each of said round modules comprise a module wrapper holding a packed fibrous material. Each of said round modules comprise a first side, a second side, a front, a back, a top, and a bottom. Each of said module wrappers comprise said first flap, said second flap, an inside surface, and an outside surface.

20 Claims, 16 Drawing Sheets

SYSTEM AND METHOD FOR UNWRAPPING ROUND MODULES

BACKGROUND

The applicants for these United States Letters Patent hereby claim the benefit of application Ser. No. 12/846,045, in which they are applicants and inventors as well. Further, said application (Ser. No. 12/846,045) is hereby incorporated by reference.

This disclosure relates to a system and method for unwrapping round modules. For purposes of this disclosure, cotton modules are discussed, and are an example of a fibrous material. However, such discussion of cotton modules is solely exemplary, and not limiting.

Methods for handling harvested cotton by cotton-harvesters, such as cotton strippers or cotton pickers, have evolved over the years. At one time, cotton would be dumped into trailers that were then delivered to the cotton gin. This system required frequent trips to the cotton gin, expending significant amounts of time and energy. Eventually, cotton strippers were developed capable of forming the cotton into rectangular cotton modules. Rectangular cotton modules eliminated the need for frequent trips to the cotton gin because modules were capable of accumulation without trailers. However, rectangular cotton modules were susceptible to damage due to environmental hazards such as moisture and wind erosion. To protect rectangular cotton modules awaiting delivery to a cotton gin, a plastic tarpaulin cover was frequently employed. Such methods of handling harvested cotton in covered rectangular cotton modules have been further improved by the introduction of cotton harvesters capable of making round modules of harvested cotton.

Round modules can be cylindrical packed cotton modules wrapped in tarpaulin covers along the side walls of the cylinder shape. They can be created of harvested cotton inside modern cotton harvesters. More comprehensively wrapped than their predecessors, round modules overcome many of the shortcomings of covered rectangular cotton modules. The round module can provide substantial savings by preventing lost or damaged cotton due to environmental deterioration. For example, round modules are less likely to absorb ground water which could foreseeably collect around the base of a cotton module.

Round modules represent a technological advancement in the handling of harvested cotton but cause new difficulty for cotton gins. Gin operators must completely separate cotton from the round module wrapper such that no contaminants from the wrapper remain during ginning.

Various methods exist for separating cotton from the round module wrapper. In one embodiment, a pair of curved arms lifts the round module and rotates the module along its cylindrical axis. A slitter for cutting the cover removes the cover during rotation. However, such system is incapable of accommodating multiple round modules simultaneously and fails to provide a uniform feed of unwrapped cotton exiting the system. In another embodiment, arm structures grasp, lift and reorient the round module into a vertical orientation, thereby allowing the weight of the cotton itself to pull the cotton out of the open bottom of the module. As the cotton drops from the module wrapper, the wrapper is retained by spikes in the grasping arm structures. Likewise, such system is also incapable of accommodating multiple round modules simultaneously and fails to produce a uniform feed of unwrapped cotton exiting the system. Further, this embodiment is likely to leave cotton bound within the uncut module wrapper.

As such it would be useful to have an improved system and method for unwrapping round modules.

SUMMARY

A round module unwrapping system and a round module unwrapping method are disclosed.

Said round module unwrapping system comprising a one or more module feeder floors and a pulling assembly. Said one or more module feeder floors capable of supporting a one or more round modules each having a module wrapper enclosing a packed fibrous material. Said one or more module feeder floors comprise a primary module feeder and a one or more titling module feeders. Said one or more titling module feeders comprise a non-inclined position and an inclined position. Said non-inclined position comprises said one or more titling module feeders substantially parallel with said primary module feeder. Said inclined position comprises a first side of said one or more titling module feeders raised higher than a second side. Said second side of said one or more titling module feeders is aligned next to said primary module feeder. said round module unwrapping system having a first side and a second side. Said pulling assembly capable of attaching to a second flap of said module wrapper with a flap clasping portion. A pulling force capable of pulling said pulling assembly. Said module wrappers, having a first flap, said second flap, an inside surface, and an outside surface, are wrapping around said packed fibrous material with said first flap releaseably attaching to said second flap. Said round modules having a first side, a second side, a front, a back, a top, and a bottom. Said module feeder floors comprises a conveyor capable of moving said one or more round modules between a first end and a second end of said round module unwrapping system.

Said round module unwrapping method comprising: supporting one or more round modules on a module feeder floor of a round module unwrapping system, detaching a first flap from a second flap of a module wrapper of said round modules, and pulling said second flap of said module wrapper. Said round module unwrapping system comprises a module feeder floor, a first side and a second side. Each of said round modules comprise a module wrapper holding a packed fibrous material. Each of said round modules comprise a first side, a second side, a front, a back, a top, and a bottom. Each of said module wrappers comprise said first flap, said second flap, an inside surface, and an outside surface.

BRIEF DESCRIPTION OF THE DRAWINGS

FIGS. 3E and 3F illustrates two elevated front views of said module rotator with a plurality of lifters.

DETAILED DESCRIPTION

Described herein is a round module unwrapping system and method. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
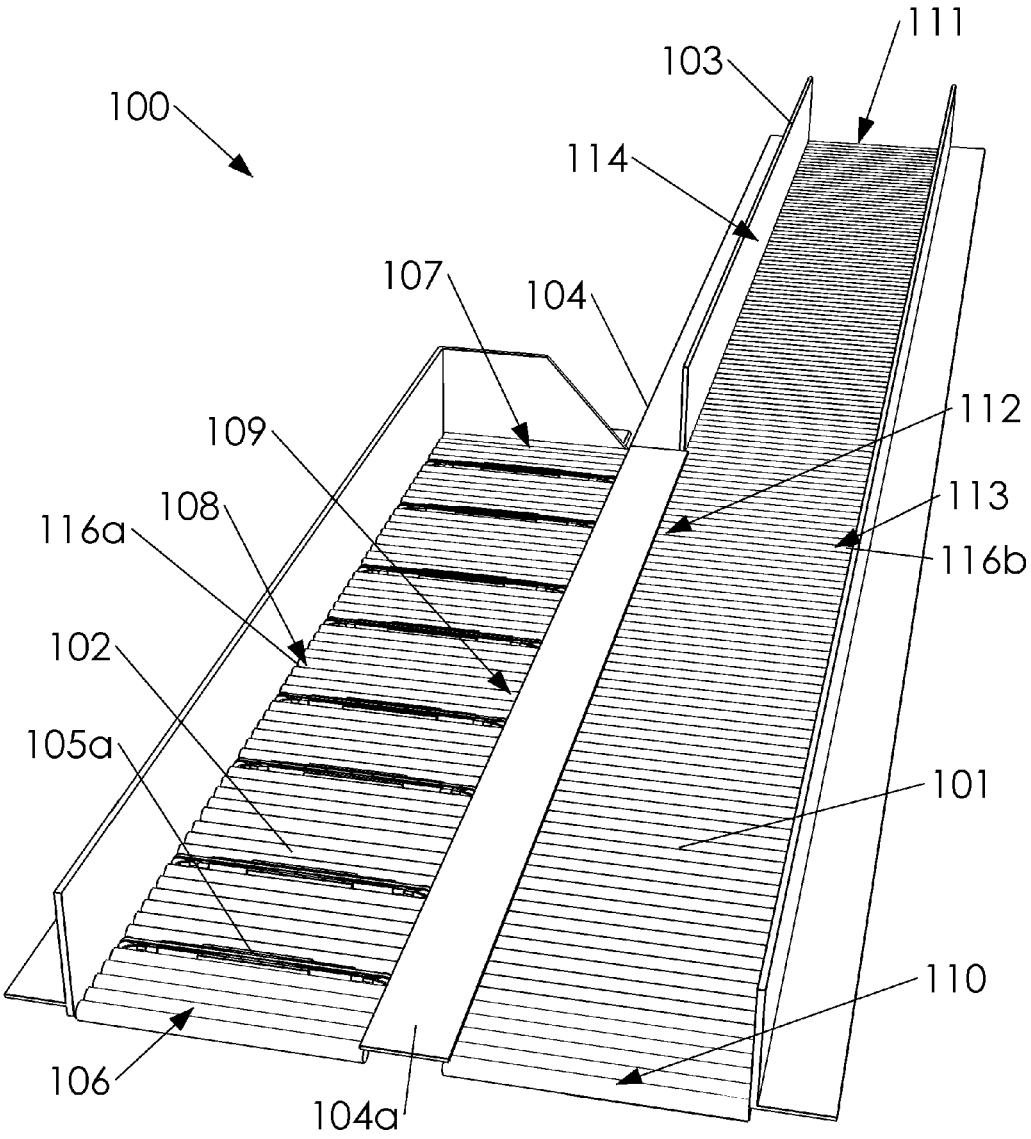
FIGS. 1A and 1B illustrate a perspective overview and an elevated top view of a round module unwrapping system.
Figure 1B:
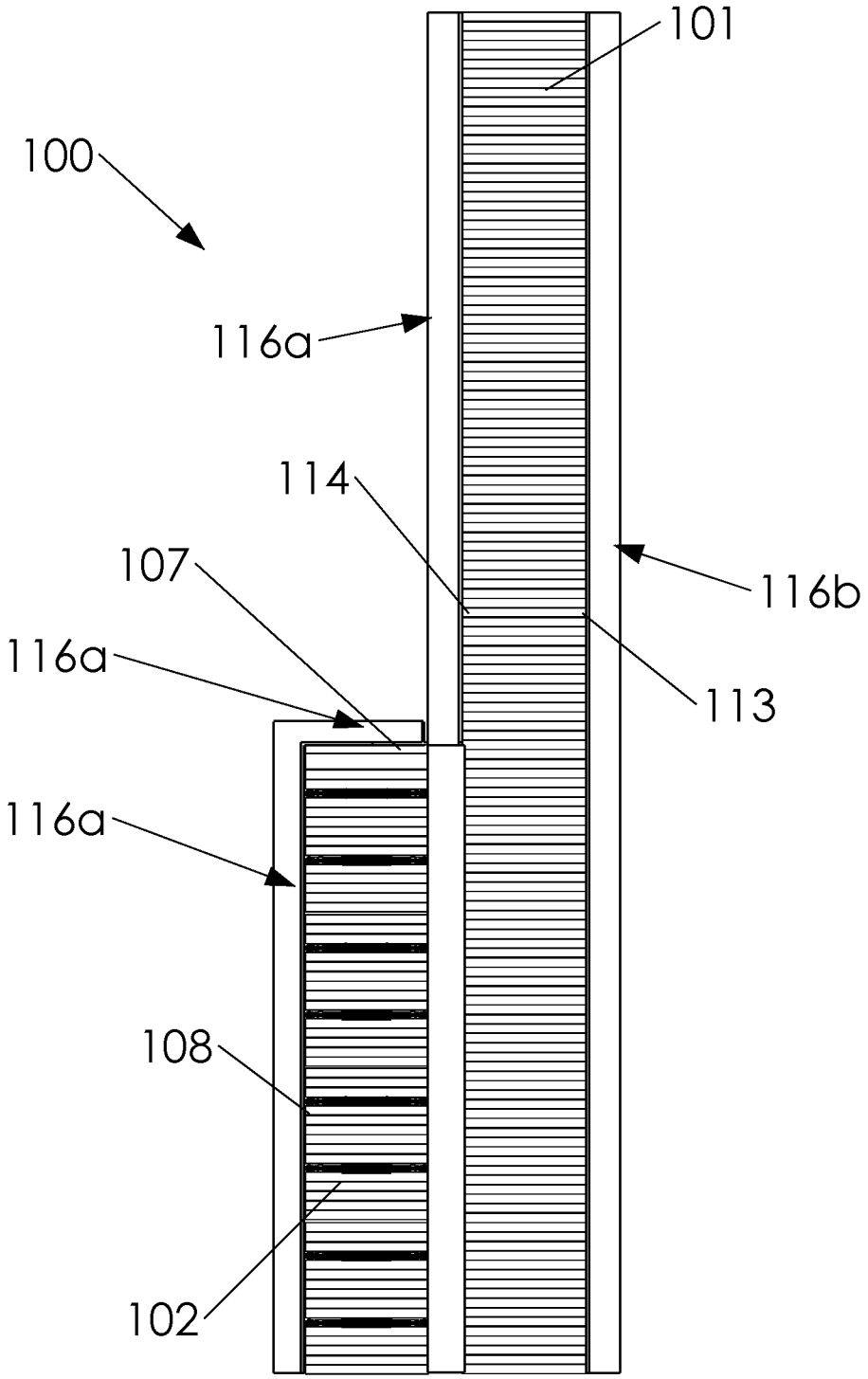

FIGS. 1A and 1B illustrate a perspective overview and an elevated top view of a round module unwrapping system 100. In one embodiment, said round module unwrapping system 100 can comprise a one or more module feeder floors, a one or more wind boards 103, a one or more catwalks 104, and/or a one or more module rotators. In one embodiment, said one or more module feeder floors can comprise a primary module feeder 101 and a one or more titling module feeders (comprising a titling module feeder 102). In one embodiment, said one or more module rotators can comprise a module rotator 105*a*. In one embodiment, said titling module feeder 102 can comprise a first end 106, a second end 107, a first side 108, and a second side 109. In one embodiment, said primary module feeder 101 can comprise a first end 110, a second end 111, a first side 112, and a second side 113. In one embodiment, said primary module feeder 101 can be longer than said titling module feeder 102. In such embodiment, said primary module feeder 101 can comprise a second end first side 114 along a portion of said first side 112 extending beyond said second side 109.

In one embodiment, said one or more module feeder floors can comprise conveyors capable of moving one or more objects between a first end and a second end of said round module unwrapping system 100. For example, in one embodiment, said titling module feeder 102 can convey an object between said first end 106 and said second end 107. In one embodiment, the term "conveyor" can comprise a roller-bed (as illustrated in FIG. 1, et. sec.), a gravity skatewheel conveyor, a gravity roller conveyor, a belt conveyor, a wire mesh conveyor, a plastic belt conveyor, a belt driven live roller, a lineshaft roller conveyor, a chain conveyor, a screw conveyor, a chain driven live roller conveyor, or the equivalent thereof.

In one embodiment, said catwalks 104 can comprise an intermediate module unwrapper catwalk 104*a*. In one embodiment, said intermediate module unwrapper catwalk 104*a* can be aligned between and abut said one or more module feeder floors. In one embodiment, said intermediate module unwrapper catwalk 104*a* can align between said primary module feeder 101 and said titling module feeder 102. In one embodiment, said intermediate module unwrapper catwalk 104*a* can comprise a part of said titling module feeder 102. In one embodiment, said intermediate module unwrapper catwalk 104*a* abuts said first side 112 and said second side 109. In another embodiment, said intermediate module unwrapper catwalk 104*a* abuts said second side 113 and said first side 108.

In one embodiment, said round module unwrapping system 100 can comprise a side portions (comprising a first side 116*a* and a second side 116*b*). In one embodiment, said first side 116*a* can comprise said first side 108 and second end 107 of said titling module feeder 102, and said second end first side 114 of said primary module feeder 101 (as illustrated in FIG. 1B). In one embodiment, said second side 116*b* can comprise said second side 113 of said primary module feeder 101. In one embodiment, round module unwrapping system 100 can comprise said wind boards 103 along said side portions of said round module unwrapping system 100. In one embodiment, said round module unwrapping system 100 can comprise said catwalks 104 along said side portions of round module unwrapping system 100. In one embodiment, round module unwrapping system 100 can comprise both wind boards 103 and catwalks 104 along said side portions of round module unwrapping system 100. In one embodiment, said wind boards 103 can block wind as well as create a retaining wall around module unwrapping system 100. In one embodiment, said catwalks 104 can allow human access to said round module unwrapping system 100 by providing a flat surface for walking. In one embodiment, where said titling module feeder 102 is aligned on said first side 112, said wind boards 103 and said module unwrapper catwalk 104 can be attached at said second end 107, said first side 108, said second side 113, and said second end first side 114.

In one embodiment, said one or more module rotators can be installed in said titling module feeder 102, as will be discussed and illustrated further infra.

Figure 2A:
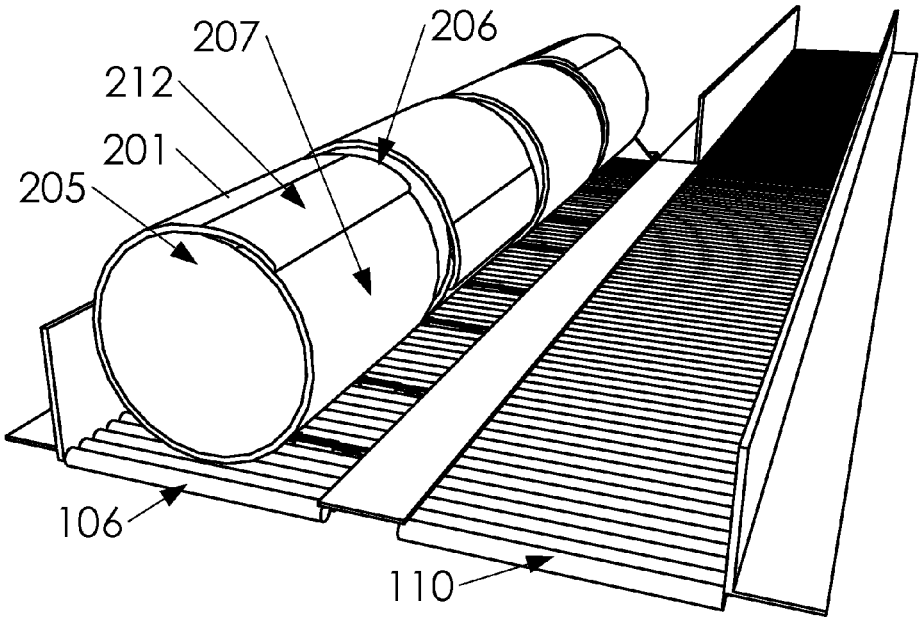
FIGS. 2A and 2B illustrate a two perspective overviews of a said one or more round modules loaded onto said titling module feeder.
Figure 2B:
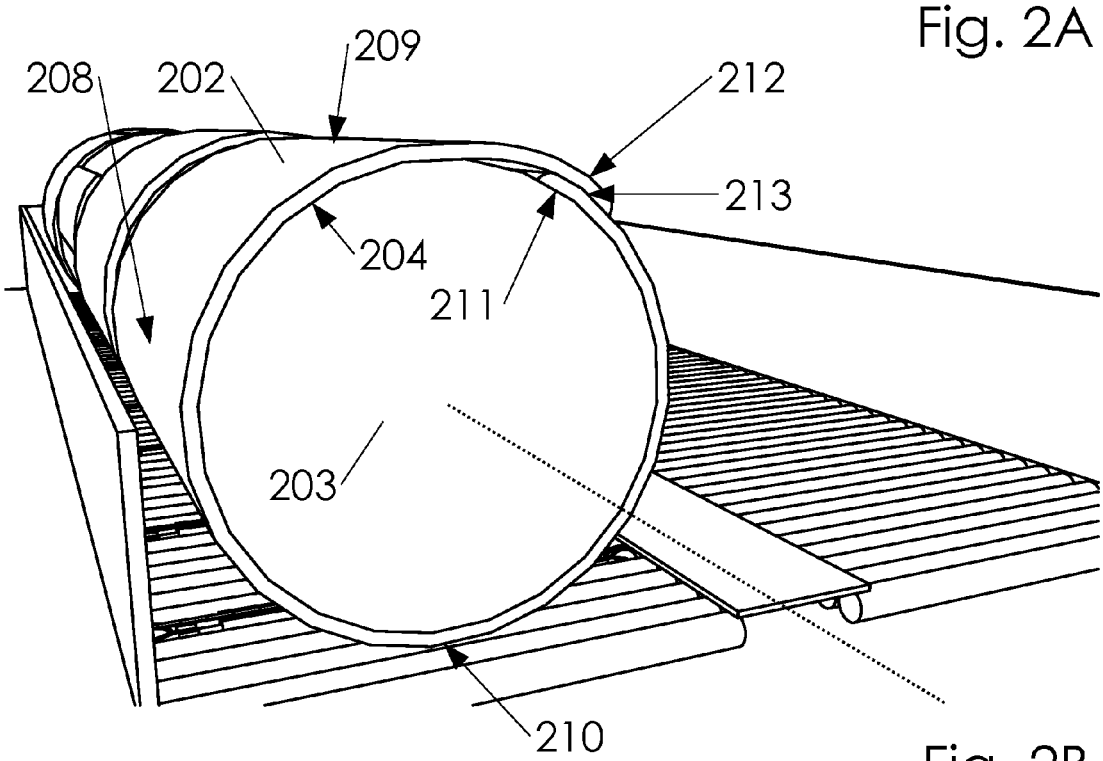

FIGS. 2A and 2B illustrate a two perspective overviews of a said one or more round modules loaded onto said titling module feeder 102. In one embodiment, said one or more round modules can comprise a round module 201. In one embodiment, said one or more round modules can each be substantially to said round module 201. In one embodiment, said round module 201 can comprise a module wrapper 202 substantially encasing a packed fibrous material 203 along a round module sidewall 204. Further, round module 201 can comprise a first side 205, a second side 206, a front 207, a back 208, a top 209, and a bottom 210. Packed fibrous material 203 can comprise cotton. In one embodiment, said module wrapper 202 can comprise a tarpaulin material wrapped around said packed fibrous material 203 and bound such that said round module 201 does not unravel prior to processing at said round module unwrapping system 100.

In one embodiment, said one or more round modules can be delivered to said round module unwrapping system 100 on a vehicle. Once delivered, said one or more round modules can be loaded onto said round module unwrapping system 100 at said first end 106. In one embodiment, said modules of fibrous materials, which are not bound as said one or more round modules, such as rectangular cotton modules, can be loaded onto said round module unwrapping system 100 at said first end 110 of said primary module feeder 101. In one embodiment, said one or more module feeder floors can support a one or more of said one or more round modules.

Figure 2C:
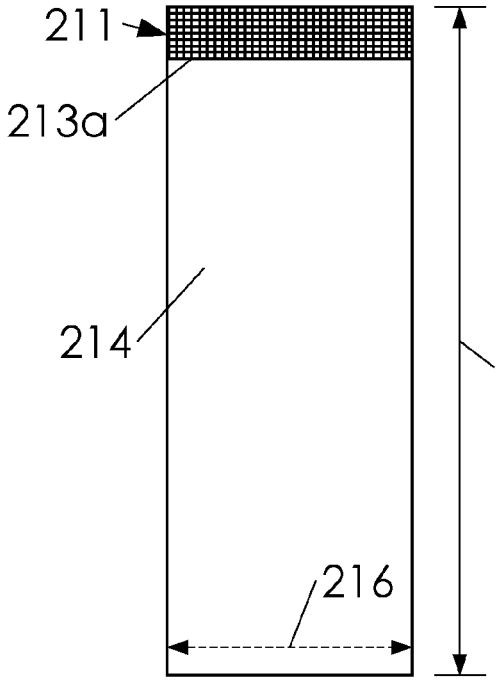
FIGS. 2C and 2D illustrate an elevated top view of an outside surface and an inside surface of module wrapper, in a flattened out configuration. In one embodiment, said module wrapper can comprise said outside surface and said inside surface.
Figure 2D:
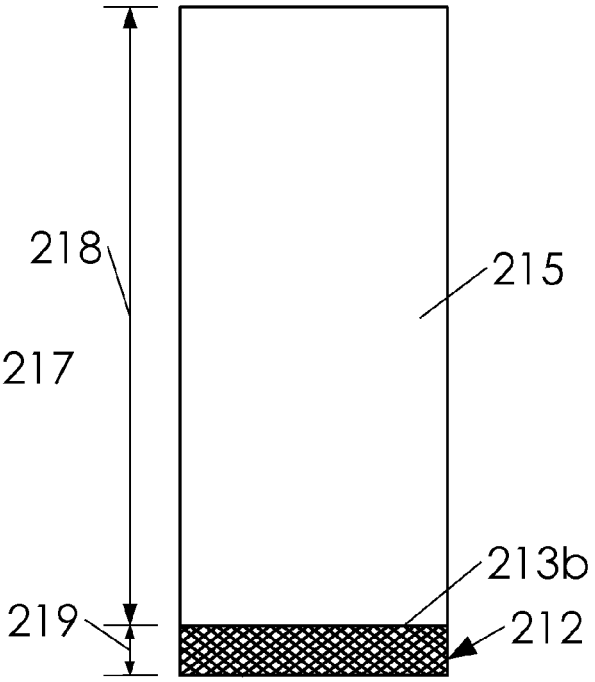

FIGS. 2C and 2D illustrate an elevated top view of an outside surface 214 and an inside surface 215 of module wrapper 202, in a flattened out configuration. In one embodiment, said module wrapper 202 can comprise said outside surface 215 and said inside surface 214. In one embodiment, said module wrapper 202 can comprise a rectangular shape having a width 216 substantially equal to a width of said round module 201 and a length 217 longer than a circumference 218 of said round module 201; wherein, an excess length 219 of said round module 201 can overlap as said module wrapper 202 wraps around said packed fibrous material 203. In one embodiment, said excess length 219 of said round module 201 can comprise a said first flap 211 and a second flap 212. In one embodiment, a flap attachment between said first flap 211 and said second flap 212 can hold said module wrapper 202 around said packed fibrous material 203. In one embodiment, said flap attachment can comprise opposing portions of a hook-and-loop fastener, such as Velcro®. In one embodiment, said hook-and-loop fastener can comprise a first portion 213*a* and a second portion 213*b*. Hook-and-loop fastener is described infra. In one embodiment, first flap 211 is capable of detaching from second flap 212 to release packed fibrous material 203. In one embodiment, first portion 213*a* attaches to outside surface 214 at first flap 211. In one embodiment, second portion 213*b* attaches to inside surface 215 at second flap 212. In one embodiment, holding packed fibrous material 203 within module wrapper 202 can comprise wrapping module wrapper 202 around packed fibrous material 203, and attaching first portion 213*a* to second portion 213*b*. In one embodiment, releasing packed fibrous material 203 from module wrapper 202 can comprise detaching first portion 213*a* from second portion 213*b*.

In another embodiment, said flap attachment can comprise an adhesive applied to the surface between first flap 211 and second flap 212, rather than hook-and-loop fastener. In such an embodiment, first flap 211 and second flap 212 are detached from one another by cutting module wrapper 202 from first side 205 to second side 206 of round module 201. In one embodiment, holding packed fibrous material 203 within module wrapper 202 can comprise wrapping module wrapper 202 around packed fibrous material 203, and attaching first flap 211 to second flap 212 with an adhesive.

In one embodiment, said module wrapper 202 can comprise a non-reusable form as disclosed in U.S. patent Ser. No. 12/846,045, filed by the Applicants of this application and hereby incorporated by reference. The claimed embodiment of said round module unwrapping system 100 herein disclosed is capable of handling a range of different embodiments of said one or more round modules, even though the figures are drawn to a reusable version of said module wrapper 202 (as shown in FIGS. 2C and 2D, et. sec.).

Figure 3A:
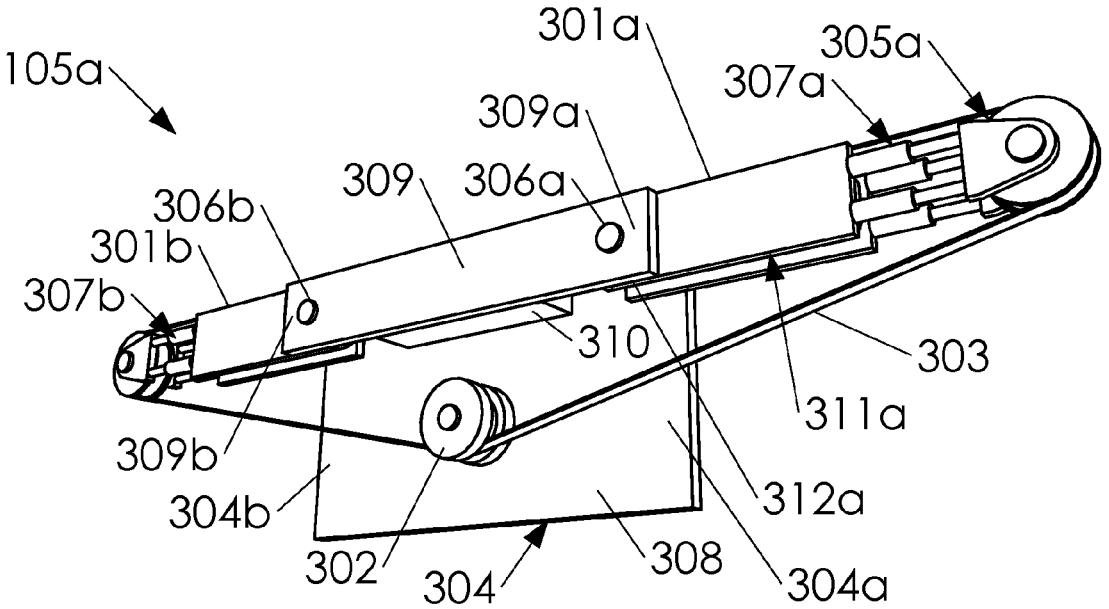
FIGS. 3A and 3B illustrate a perspective overview and a perspective detailed view of said module rotator in a non-use position.
Figure 3B:
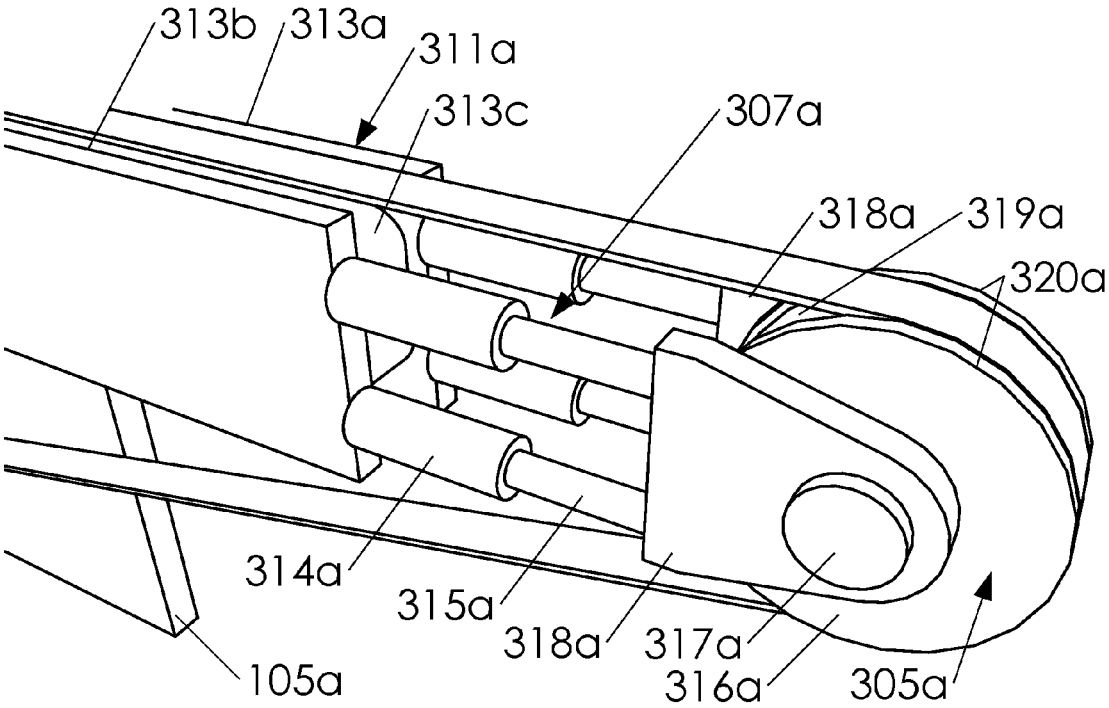

FIGS. 3A and 3B illustrate a perspective overview and a perspective detailed view of said module rotator 105*a* in a non-use position. One or more module rotators can comprise a plurality of positions such as an in-use position and said non-use position. In one embodiment, said module rotator 105*a* can comprise a one or more actuating arms (comprising a first arm 301*a* and a second arm 301*b*), a belt driveshaft 302, a belt 303, and a body 304. In one embodiment, said body 304 can comprise a first side 304*a* and a second side 304*b*. In one embodiment, each of said one or more actuating arms can comprise a pulley assembly (such as a pulley assembly 305*a*) and an arm hinge (such as a hinge 306*a*).

In one embodiment, said first arm 301*a* can comprise a pulley assembly 305*a*, an arm hinge 306*a*, and an accumulator assembly 307*a*. In one embodiment, said second arm 301*b* can comprise a pulley assembly 305*b*, an arm hinge 306*b*, and an accumulator assembly 307*b*. Each of said one or more actuating arms can be configured as described as follows for said first arm 301*a*. In one embodiment, said pulley assembly 305*a* can attach to an internal portion 311*a* of said first arm 301*a* with said accumulator assembly 307*a*. In one embodiment, said accumulator assembly 307*a* can comprise a one or more accumulators (as illustrated with four such accumulators). In one embodiment, each of said accumulators can comprise a cylinder 314*a* and a piston 315*a*. In one embodiment, said internal portion 311*a* can comprise a back plate 313*a*, a front plate 313*b*, and an internal portion 313*c*. In one embodiment, internal portion 313*c* can attach between back plate 313*a* and front plate 313*b*, as illustrated in FIG. 3B. In one embodiment, internal portion 313*c* can comprise rounded corners so as to minimize damage to belt 303 as belt 303 rotates past said one or more actuating arms.

In one embodiment, body 304 can comprise a back plate 308, a front plate 309, and a connector 310. In one embodiment, said first end 312*a* of said first arm 301*a* can attach to a first side 309*a* of said front plate 309 with said hinge 306*a*, as illustrated in FIG. 3A. Similarly, said second arm 301*b* can attach at a second side 309*b* of front plate 309 with hinge 306*b*. In one embodiment, arm hinges 306 can hold said one or more actuating arms to body 304 by holding said one or more actuating arms between back plate 308 and body 304. In one embodiment, said one or more actuating arms can each comprise an axis at arm hinges 306.

In one embodiment, accumulator assembly 307*a* can comprise a one or more springs, accumulators, hydraulic accumulators, spring accumulators, or similar. In one embodiment, as in FIG. 3A-3E, accumulator assembly 307 can comprise a plurality of accumulators each comprising a cylinder (such as said cylinder 314*a*) and a floating rod (such as said piston 315*a*). In one embodiment, cylinder 314*a* can comprise a pressure storage reservoir (which can comprise a pressurized fluid) in which can be held under pressure by a spring, a raised weight or a compressed gas. In one embodiment, said piston 315*a* can be pressed outward, away from said cylinder 314*a*, by pressure in said pressure storage reservoir. In one embodiment, said accumulator assembly 307*a* can press said pulley assembly 305*a* outward from said hinge 306*a*.

In one embodiment, as with the others among said pulley assemblies, said pulley assembly 305*a* can comprise a wheel 316*a*, an axle 317*a*, a one or more side portions 318*a*. In one embodiment, said wheel 316*a* can be held between said one or more side portions 318*a* by said axle 317*a*. In one embodiment, said wheel 316*a* can spin upon said axle 317*a*. In one embodiment, said belt 303 can rotate around a portion of said wheel 316*a*. In one embodiment, said wheel 316*a* can comprise a groove 319*a* between a one or more flanges 320*a*. In one embodiment, said belt 303 fits between said flanges 320*a*. In one embodiment, said belt 303 can comprise a flat belt lacking discrete interlocking members as would be found on a chain sprocket, spur gear, timing belt, a chain belt, or similar. In one embodiment, said belt 303 can be varying widths as necessary. In one embodiment, said belt 303 can comprise a width sufficient to support a portion of said round module 201, as discussed infra. In one embodiment, said belt 303 can comprise an 8" width. In one embodiment, said wheel 316 can comprise a slightly convex external surface to keep a flat belt centered. In another embodiment, said belt 303 can comprise a chain sprocket, spur gear, or timing belt.

In one embodiment, belt 303 can wrap around a multi-point loop comprising said wheel 316*a*, a wheel 316*b*, and said belt driveshaft 302. Said wheel 316*a* can comprise a portion of said pulley assembly 305*a*. In one embodiment, said wheel 316*b* can comprise a portion of said a second pulley assembly 305*b*. In one embodiment, said belt 303 can be kept tight between said wheel 316*a* and said wheel 316*b* by pressing said pulley assembly 305*a* and said pulley assembly 305*b* substantially apart from one another with said accumulator assembly 307*a* and said accumulator assembly 307*b*.

In one embodiment, said accumulator assemblies (comprising said accumulator assembly 307*a* and said accumulator assembly 307*b*) can attach said one or more actuating arms to said pulley assemblies (comprising said pulley assembly 305*a* and said pulley assembly 305*b*). In one embodiment, one or more of said accumulators can attach said front plate 313*b* to a portion of side portion 318*a*. In one embodiment, a different one or more accumulators can attach back plate 313*a* to a different portion of side portion 318*a*.

Figure 3C:
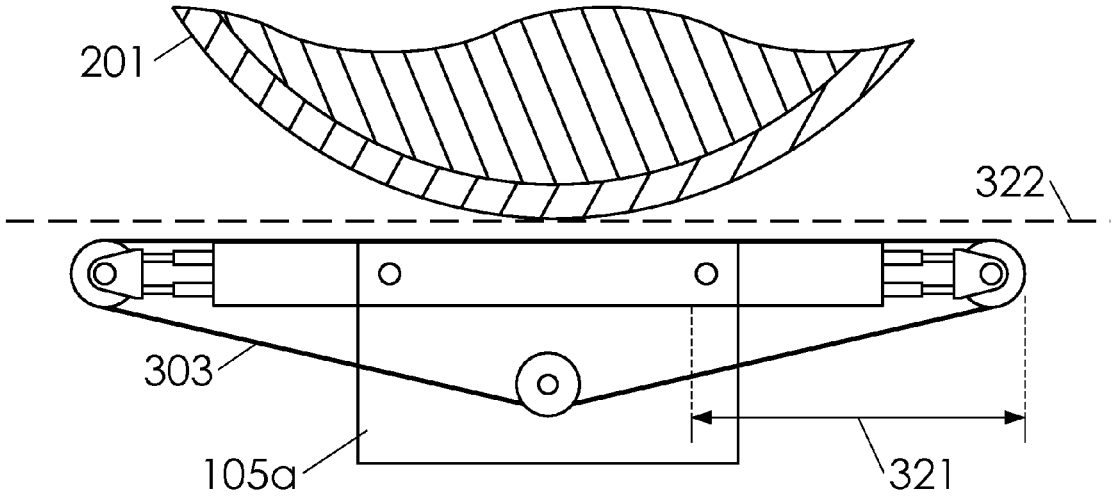
FIG. 3C illustrates an elevated front view of said module rotator in said non-use position with a cross section of said module wrapper.

FIG. 3C illustrates an elevated front view of said module rotator 105*a* in said non-use position with a cross section of said module wrapper 202. In one embodiment, said one or more actuating arms can comprise a non-use length 321. In one embodiment, said non-use length 321 can comprise a length of each of said one or more actuating arms when said one or more actuating arms are in said non-use position. While in said non-use position, said module rotator 105*a* can be below a floor level 322; wherein, floor level 322 represents a top surface level of titling module feeder 102, primary module feeder 101, and/or said one or more module feeder floors.

Figure 3D:
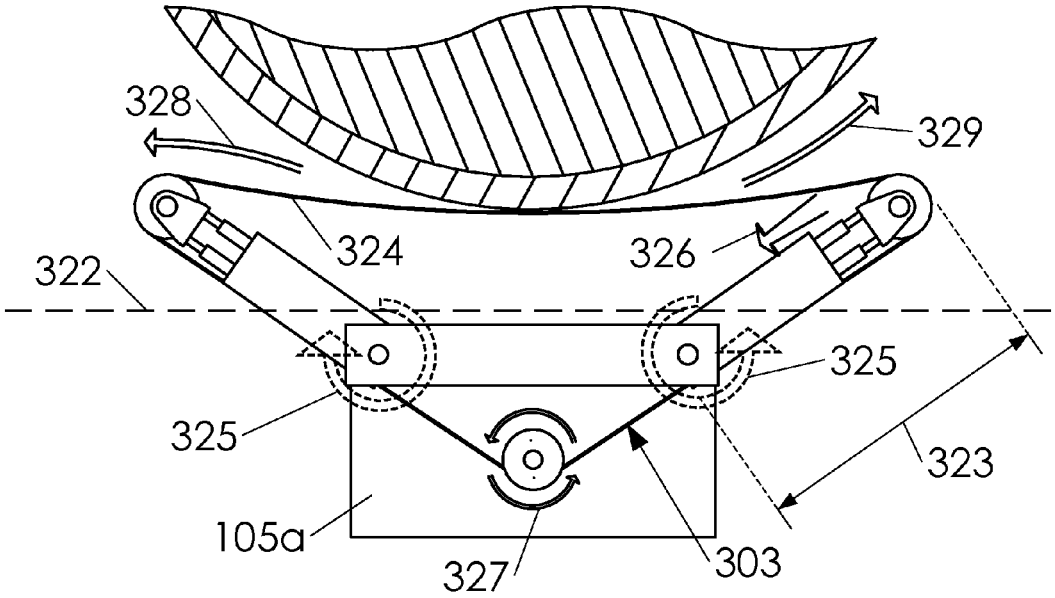
FIGS. 3D, 3E and 3F illustrate a plurality of elevated front views of said module rotator in said in-use position with a cross-section view of module wrapper.
Figure 3E:
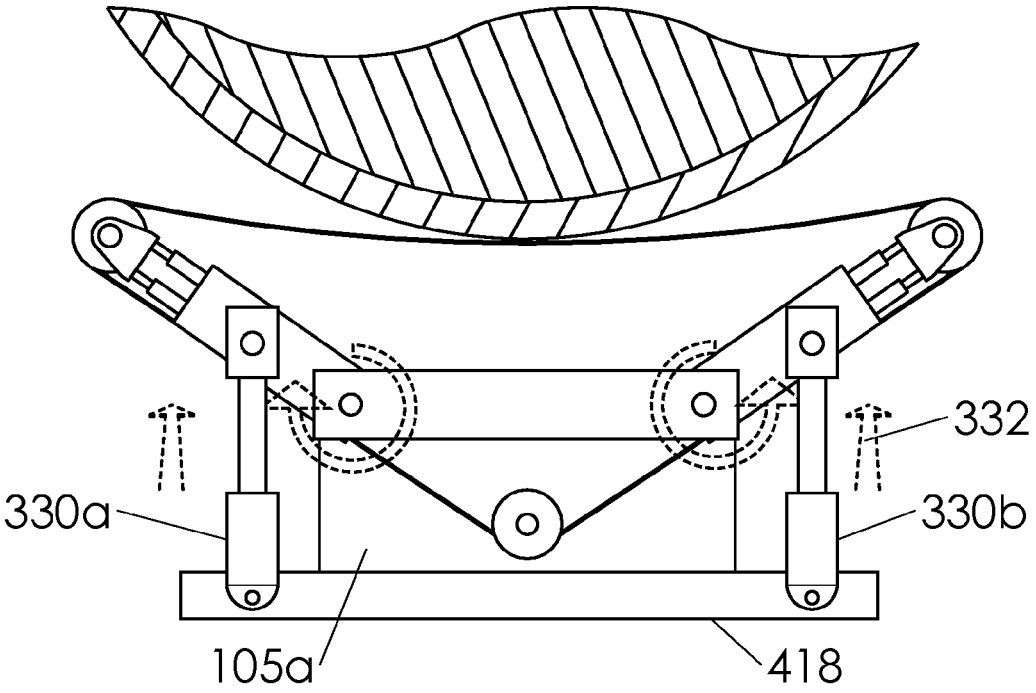
Figure 3F:
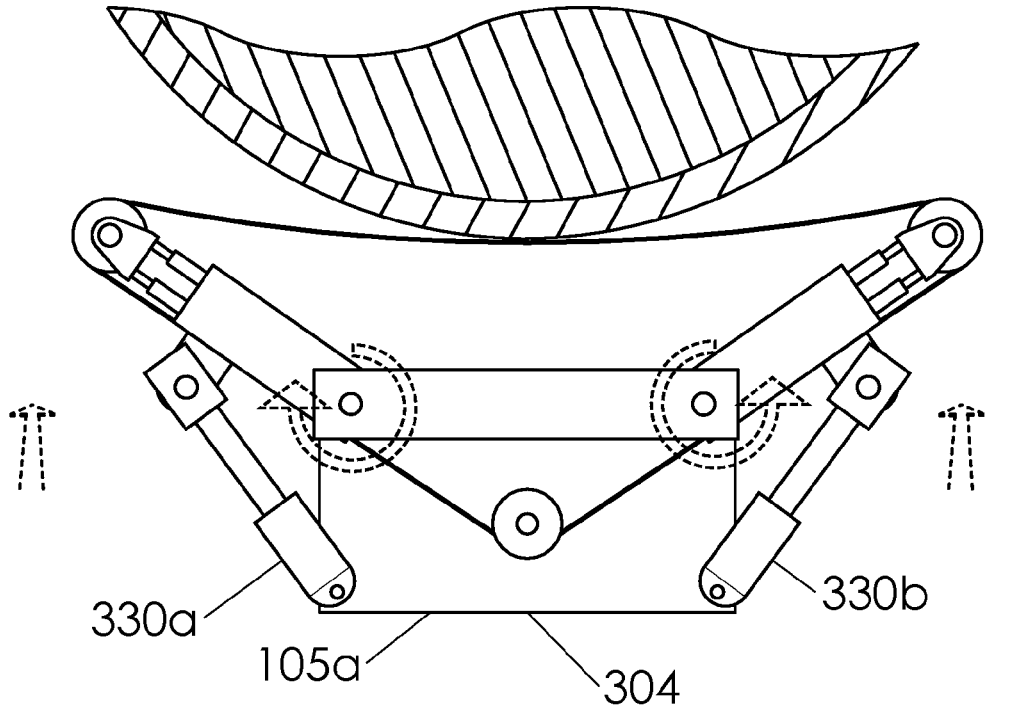

FIGS. 3D, 3E and 3F illustrate a plurality of elevated front views of said module rotator 105*a* in said in-use position with a cross-section view of module wrapper 202. In one embodiment, where said module rotator 105*a* is in said in-use position, said module rotator 105*a* can comprise an in-use length 323. In one embodiment, a portion of belt 303 can comprise a top belt portion 324. In one embodiment, top belt portion 324 can comprise a portion of belt 303 elevated above floor level 322 and between pulley assembly 305*a* and pulley assembly 305*b*. In one embodiment, one or more of said module rotator 105*a* can be transitioned from said non-use position to said in-use position by: asserting a pivoting motion 325 said one or more actuating arms up at arm hinges 306; and compressing 326 said accumulator assemblies 307. In one embodiment, compressing 326 said accumulator assembly 307 can cause non-use length 321 to decrease into an in-use length 323. In one embodiment, an external circumference of belt 303 is constant; thus, reducing non-use length 321 to in-use length 323 provides space within belt 303 for said one or more actuating arms to said pivoting motion 325. In one embodiment, said pivoting motion 325 said one or more actuating arms can comprise attaching arm hinges 306 and said one or more actuating arms to a lever capable of said pivoting motion 325 said arm hinges 306 and said one or more actuating arms.

In one embodiment, rotating 327 said belt driveshaft 302 with a rotatory power source can be used for rotating 328 said belt 303 around said multi-point loop. Said rotatory power source can be an engine, motor, or similar. In one embodiment, rotating 327 said belt driveshaft 302 counter-clockwise results in rotating 328 said belt 303, which can result in rotating 329 said round module 201. In one embodiment, said rotating 329 can reverse.

FIGS. 3E and 3F illustrates two elevated front views of said module rotator 105*a* with a plurality of lifters. In one embodiment, said module rotator 105*a* can comprise one or more of said plurality of lifters. For example, in one embodiment, said module rotator 105*a* can comprise a first lifter 330*a* and a second lifter 330*b*. In one embodiment, each of said plurality of lifters can be attached to one of said one or more actuating arms with a hinge, as illustrated in FIG. 3E. In one embodiment, applying said pivoting motion 325 to said one or more actuating arms can comprise applying a pushing motion 332 said one or more actuating arms with said plurality of lifters. In one embodiment, said plurality of lifters can be attached to a hydraulic lifting mechanism capable of pushing 332 said plurality of lifters. In one embodiment, said plurality of lifters can attach to said a horizontal member 418 (as illustrated in FIG. 3E) or to a portion of said body 304 of said module rotator 105*a* (as illustrated in FIG. 3F).

Figure 4A:
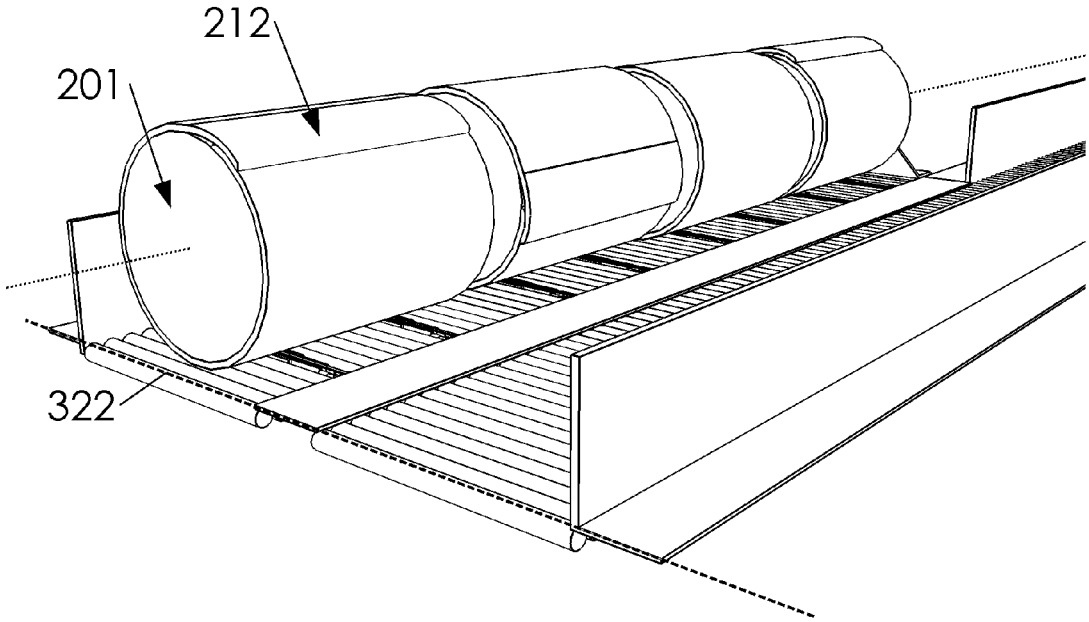
FIG. 4A illustrates a perspective side overview of said one or more round modules on said tilting module feeder with said one or more round modules in a non-aligned orientation.

FIG. 4A illustrates a perspective side overview of said one or more round modules on said tilting module feeder 102 with said one or more round modules in a non-aligned orientation. In one embodiment, said non-aligned orientation can comprise more than one said one or more round modules loaded on round module unwrapping system 100 wherein first flap 211 and second flap 212 of each round module 201 do not align with one another. It is statistically likely that, when loading a plurality of round module 201 onto round module unwrapping system 100, said one or more round modules will be in a non-aligned orientation. This is because the parties responsible for collecting and/or delivering said one or more round modules to round module unwrapping system 100 are not responsible for orienting round module 201 in any particular manner.

Figure 4B:
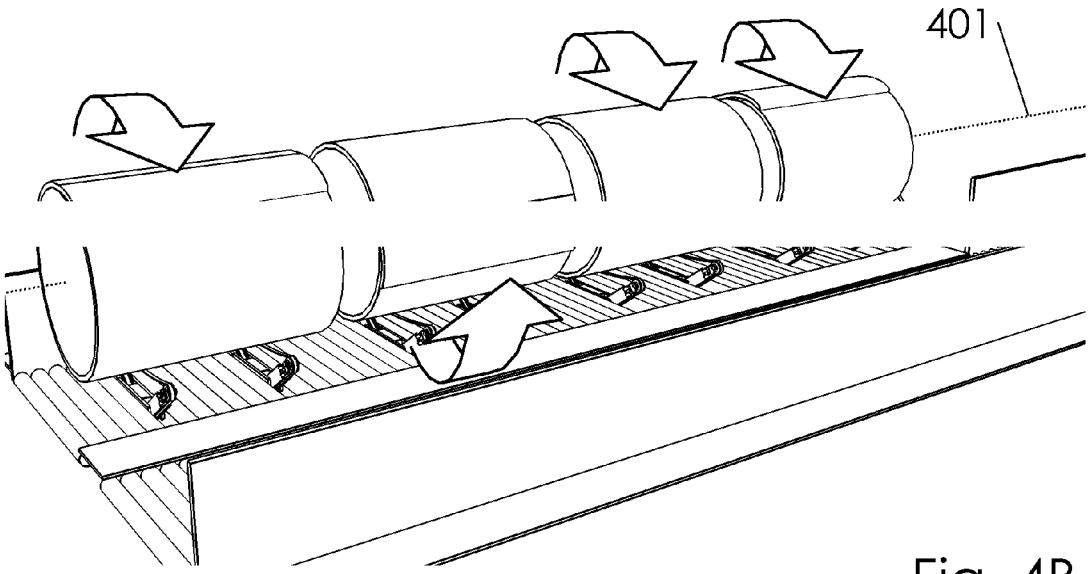
FIGS. 4B and 4C illustrates a perspective side overview and detailed side overview of said one or more round modules transitioning from said non-aligned orientation to an aligned orientation.
Figure 4C:
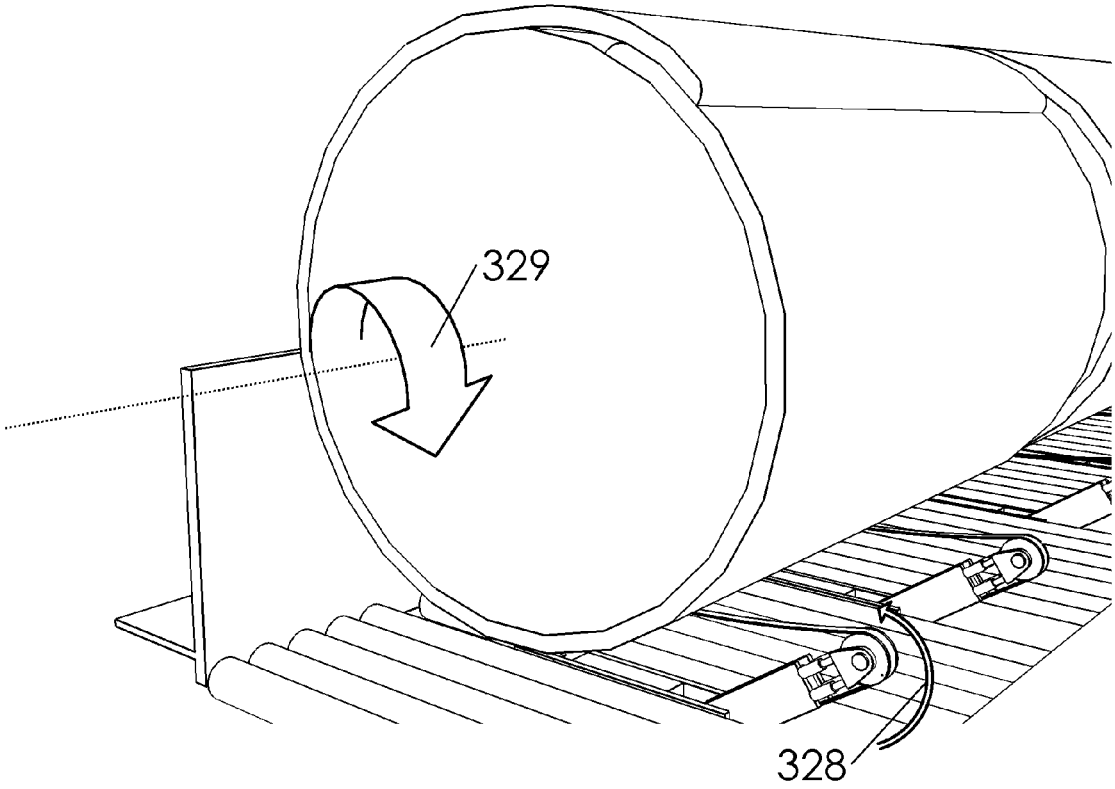

FIGS. 4B and 4C illustrates a perspective side overview and detailed side overview of said one or more round modules transitioning from said non-aligned orientation to an aligned orientation. Said aligned orientation can comprise more than one said one or more round modules loaded on round module unwrapping system 100 wherein first flap 211 and second flap 212 of each round module 201 align with one another. In one embodiment, said aligned orientation can comprise first flap 211 and second flap 212 of each round module 201 facing second side 116*b* of round module unwrapping system 100. In one embodiment, it is not advantageous for round module 201 to be in said non-aligned orientation prior to being unwrapped. Rather, it can be helpful for said one or more round modules to be in said aligned orientation prior to being unwrapped. In one embodiment, said one or more round modules can be rotated on said module rotator 105*a* with a rotating procedure comprising: loading each of round module 201 over one or more module rotators in said non-use position; said pivoting motion 325 said one or more module rotators into said in-use position; rotating each belt 303 until round module 201 and thereby rotating each of said one or more round modules about a module axis 401; orienting each of said one or more round modules into said aligned orientation. In one embodiment, wherein said two or more one or more module rotators are aligned under a single round module 201, each belt 303 of said two or more one or more module rotators can be linked and caused to start, stop, and rotate at the same time and rates in order to ensure that said single round module 201 rotates evenly over said two or more one or more module rotators.

Figure 4D:
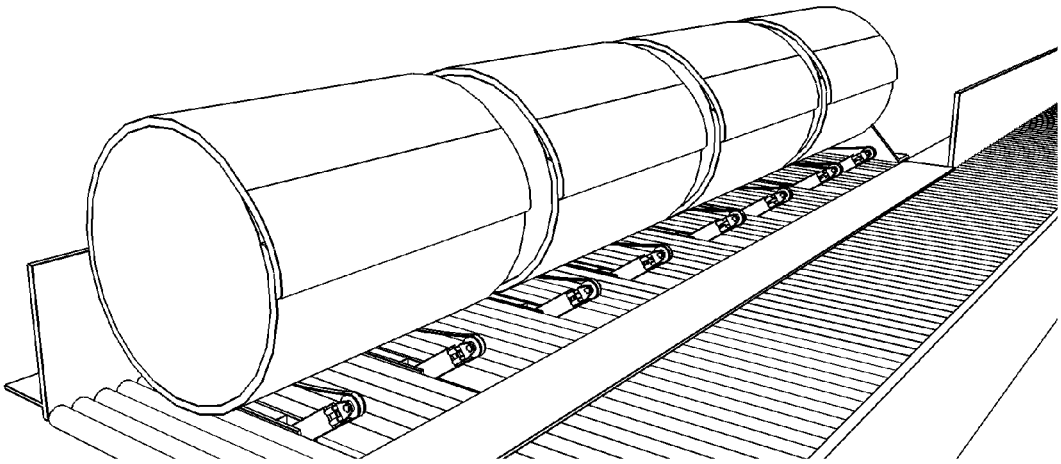
FIG. 4D illustrates a perspective side overview of said one or more round modules lifted on said one or more module rotators and in said aligned orientation.

FIG. 4D illustrates a perspective side overview of said one or more round modules lifted on said one or more module rotators and in said aligned orientation.

Figure 5A:
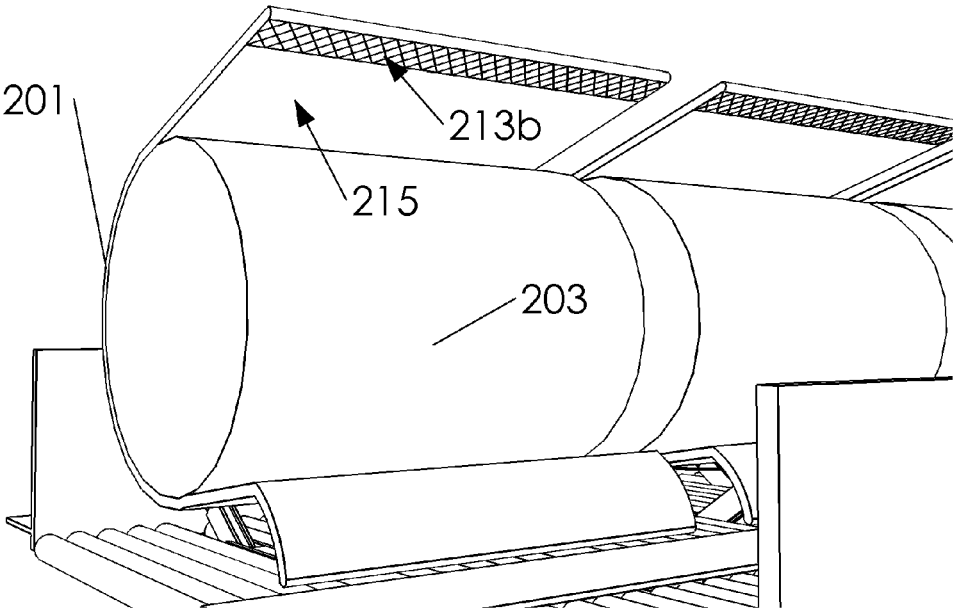
FIGS. 5A and 5B illustrate a front and rear view of said round module in an open configuration.
Figure 5B:
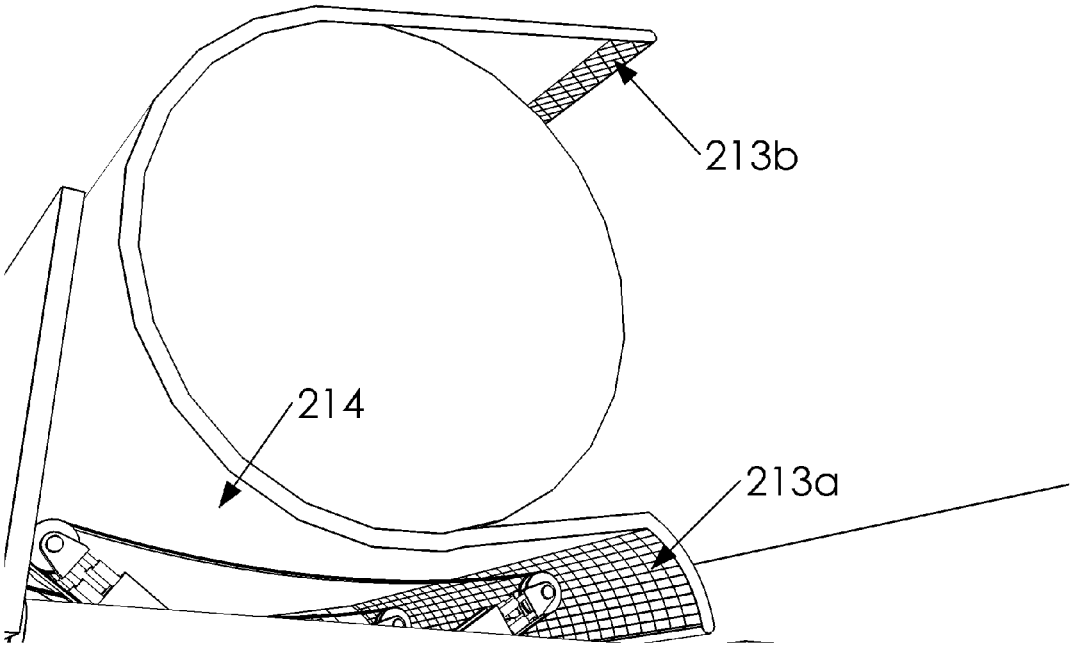

FIGS. 5A and 5B illustrate a front and rear view of said round module 201 in an open configuration. In one embodiment, placing said one or more round modules into said open configuration comprises rotating said one or more round modules into said aligned orientation and breaking said flap attachment between first flap 211 and second flap 212. In one embodiment, breaking said flap attachment can comprise detaching said first portion 213*a* from said second portion 213*b* of said hook-and-loop fastener. In one embodiment, first portion 213*a* can attach to inside surface 215 at first flap 211. In one embodiment, second portion 213*b* can attach to outside surface 214 at second flap 212. Accordingly, in one embodiment, holding packed fibrous material 203 within module wrapper 202 can comprise wrapping module wrapper 202 around packed fibrous material 203 and attaching second portion 213*b* to first portion 213*a*.

Figure 6:
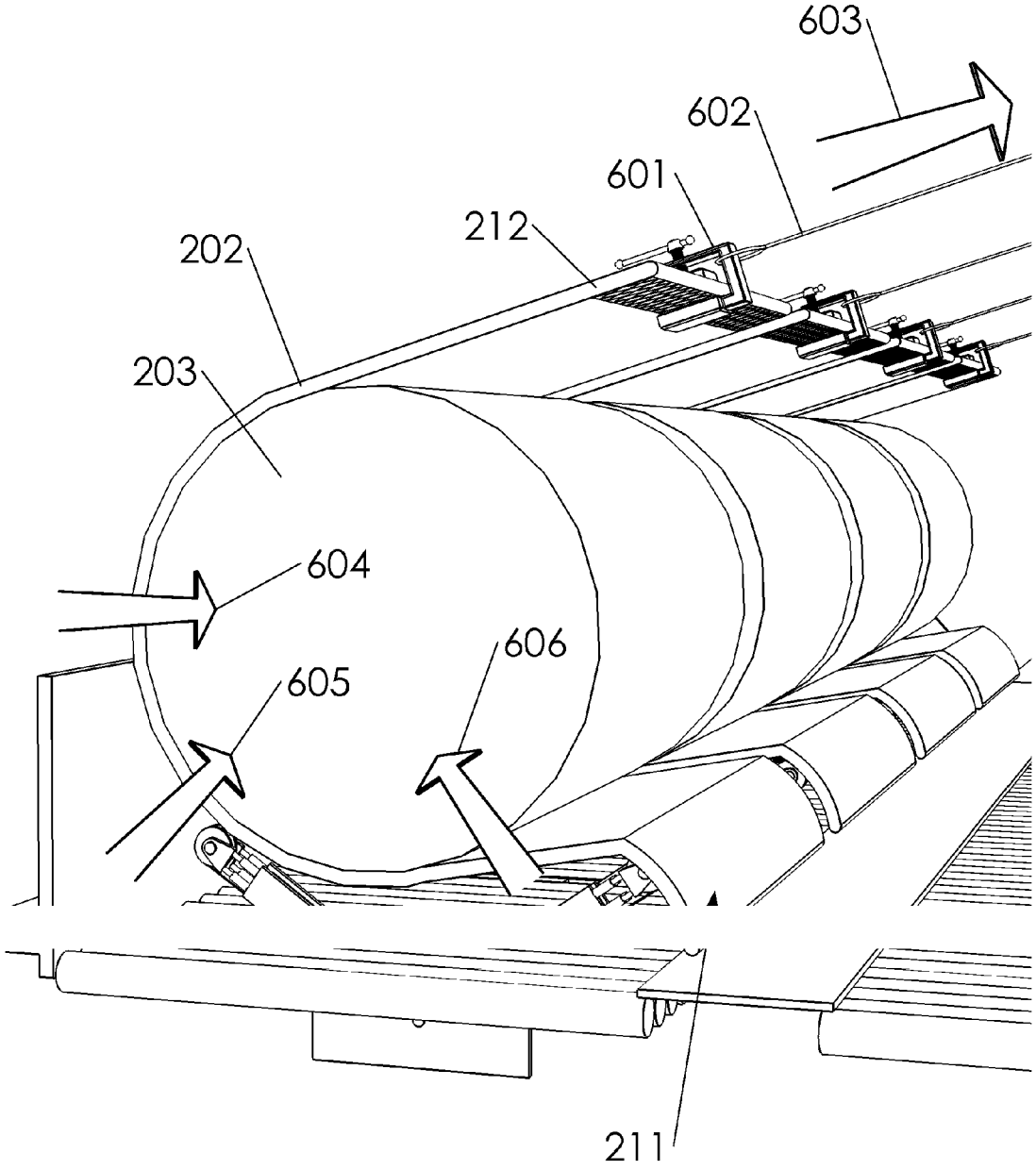
FIG. 6 illustrates round module in said open configuration with a pulling assembly pulling on said second flap.

FIG. 6 illustrates round module 201 in said open configuration with a pulling assembly 601 pulling on said second flap 212. In one embodiment, said round module unwrapping system 100 can comprise said pulling assembly 601. In one embodiment, pulling assembly 601 can comprise a line 602. In one embodiment, pulling assembly 601 can attach to module wrapper 202 with a flap clasping device. The term "clasp" is defined here as a device for fastening or holding two things together; accordingly, said flap clasping device can comprise several means of holding a portion of module wrapper 202. In one embodiment, pulling said module wrapper 202 can comprise: attaching said flap clasping device to second flap 212 and pulling with a pulling force 603. Pulling force 603 can be capable of pulling said pulling assembly 601 and thereby separating module wrapper 202 from packed fibrous material 203. Line 602 can be a cable, chain, rope, wire, cord, or any equivalent thereof.

In one embodiment, pulling force 603 can be created by running line 602 through a pulley, and attaching a counterweight to line 602 on the opposite side of said pulley from said pulling assembly 601. In another embodiment, pulling force 603 can be applied by pulling line 602 with a tension clutch or the equivalent thereof. In another embodiment, pulling force 603 can comprise pulling assembly 601 pulled by a hydraulic arm rather than line 602.

In one embodiment, where said one or more round modules are in said open configuration, packed fibrous material 203 can be supported and kept substantially intact within module wrapper 202 by a set of module wrapper forces. Said module wrapper forces can comprise a back force 604, a lower back force 605, and a lower front force 606. In one embodiment, lower back force 605 and lower front force 606 can be created by said one or more actuating arms pressing up and against a lower portion of each round module 201, as shown in FIG. 6. In one embodiment, back force 604 can comprise holding a portion of module wrapper 202 against packed fibrous material 203 by pulling a portion of module wrapper 202 with pulling force 603 and holding a portion of module wrapper 202 with lower back force 605, as illustrated in FIG. 6.

Figure 7A:
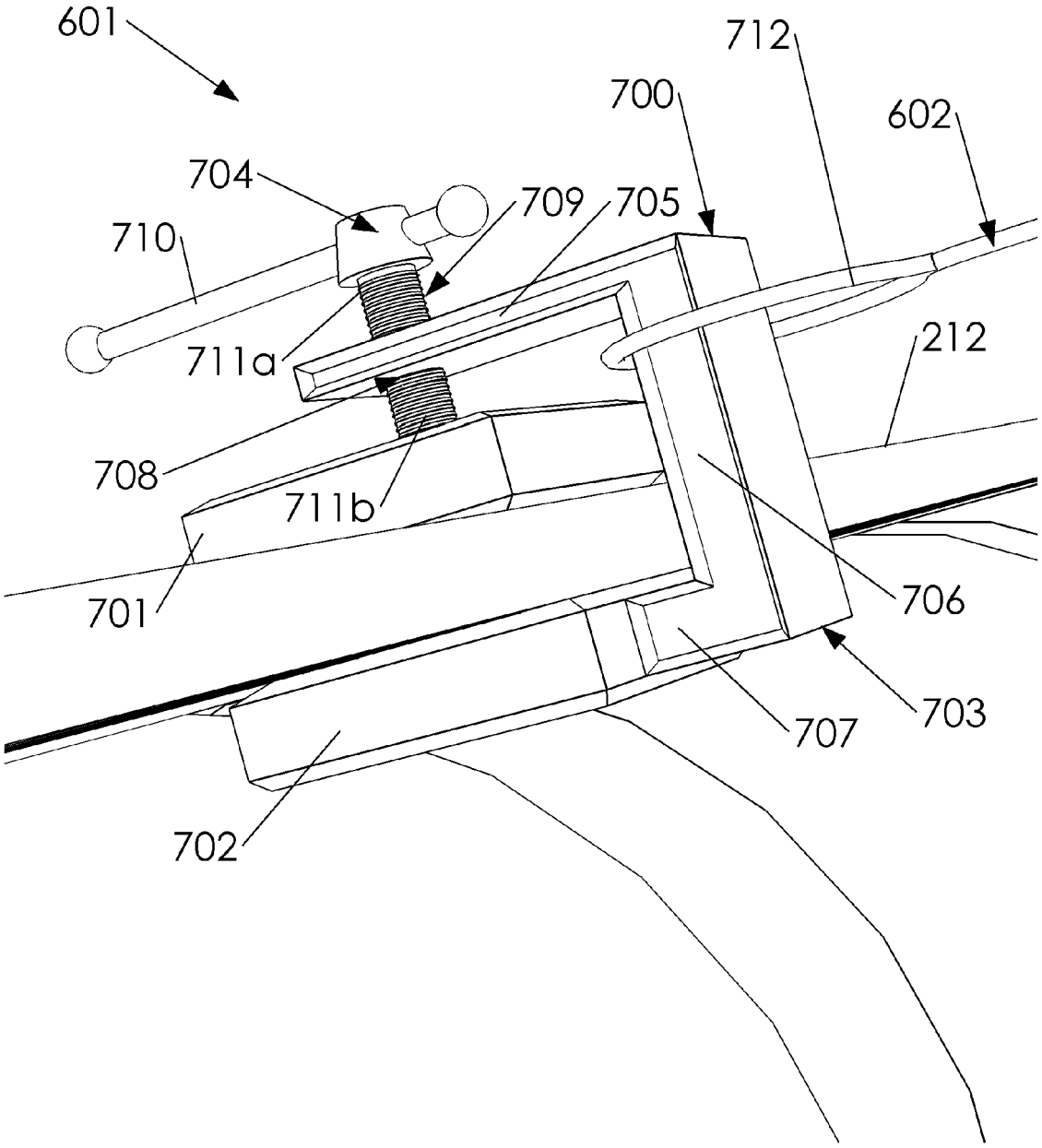
FIG. 7A illustrates a detailed view of a clamp.

FIG. 7A illustrates a detailed view of a clamp 700. In one embodiment, said flap clasping portion can comprise clamp 700. In one embodiment, pulling assembly 601 can comprise clamp 700 and a line receiving portion. In one embodiment, clamp 700 can comprise a first paddle 701, a second paddle 702, a connecting bracket 703, and a pressing assembly 704. In one embodiment, connecting bracket 703 can comprise a U-shaped member wherein a first portion 705, a second portion 706, and a third portion 707 comprise the three primary portions of said "U" shape. As illustrated in FIG. 7, in one embodiment, third portion 707 can attach to second paddle 702, and pressing assembly 704 can attach to first portion 705 and first paddle 701. In one embodiment, pressing assembly 704 can be used to press and hold first paddle 701 toward and/or against second paddle 702. Accordingly, in on embodiment, an object can be held between first paddle 701 and second paddle 702 by applying pressure with pressing assembly 704.

Clamp 700 can clamp upon an object by a variety of well-known clamping means, as will be evident to persons skilled in the art. In one embodiment, said clamping means can comprise pressing and holding an object between first paddle 701 against second paddle 702. Connecting bracket 703 can comprise a threaded hole 708. Pressing assembly 704 can comprise a threaded shaft 709 and a turning assembly 710. In one embodiment, threaded shaft 709 can attach to turning assembly 710 at a first end 711*a* of threaded shaft 709 and first paddle 701 at a second end 711*b* of threaded shaft 709; further, threaded shaft 709 can be screwed through threaded hole 708 between turning assembly 710 and first paddle 701. In one embodiment, said clamping means can comprise holding module wrapper 202 by rotating turning assembly 710, screwing threaded shaft 709 through threaded hole 708, and clamping second flap 212 between first paddle 701 and second paddle 702. In one embodiment, pressing assembly 704 is capable of pressing first paddle 701 toward second paddle 702 by rotating threaded shaft 709 with pressing assembly 704, adjusting a position of threaded shaft 709 within threaded hole 708, and moving first paddle 701 toward second paddle 702.

In one embodiment, said line receiving portion of pulling assembly 601 can hold a portion of line 602. In one embodiment, line 602 can comprise a loop 712. In one embodiment, loop 712 can comprise a portion of line 602 wrapped back around and tied to itself to form a loop. In another embodiment, loop 712 can comprise a solid round object with an open interior forming a ring or hoop; wherein line 602 can be tied to loop 712. In one embodiment, line 602 can be attached to pulling assembly 601 by attaching loop 712 to connecting bracket 703; wherein connecting bracket 703 comprises said line receiving portion of pulling assembly 601. In another embodiment, line 602 can be attached to pulling assembly 601 by tying line 602 to a portion of connecting bracket 703.

Figure 7B:
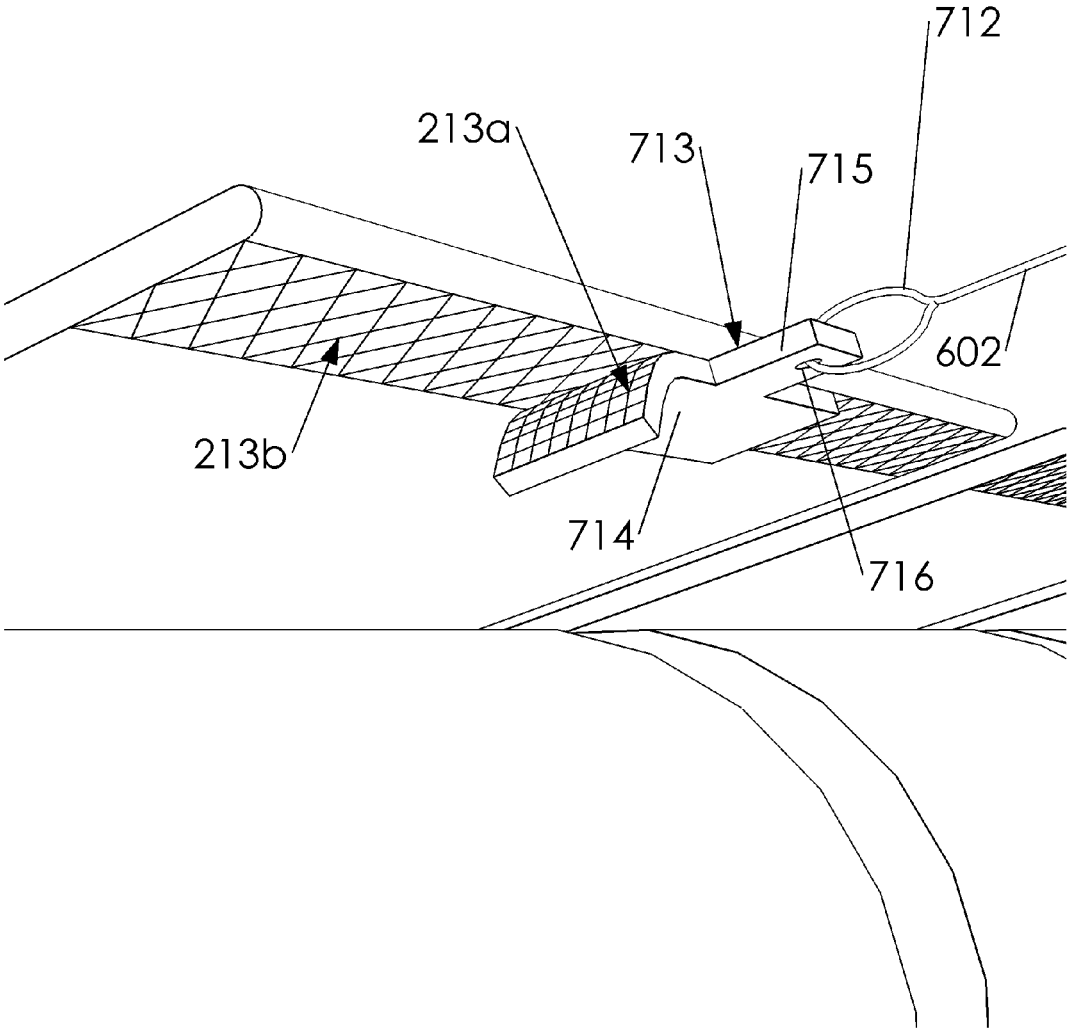
FIG. 7B illustrates detailed view of a hook-and-loop clasping device.

FIG. 7B illustrates detailed view of a hook-and-loop clasping device 713. In one embodiment, said flap clasping device can comprise hook-and-loop clasping device 713. In one embodiment, hook-and-loop clasping device 713 can comprise a body 714. In one embodiment, hook-and-loop clasping device 713 can further comprise a line receiving portion 715. In one embodiment, body 714 can comprise first portion 213*a* of hook-and-loop fastener. In one embodiment, line receiving portion 715 can comprise a hole 716. In one embodiment, line receiving portion 715 can receive line 602 by attaching a loop 712 to hole 716. In one embodiment, attaching hook-and-loop clasping device 713 to module wrapper 202 can comprise pressing first portion 213*a* on body 714 against second portion 213*b* on second flap 212. Thus, pulling assembly 601 can attach to module wrapper 202 with either clamp 700 or hook-and-loop clasping device 713.

Figure 8A:
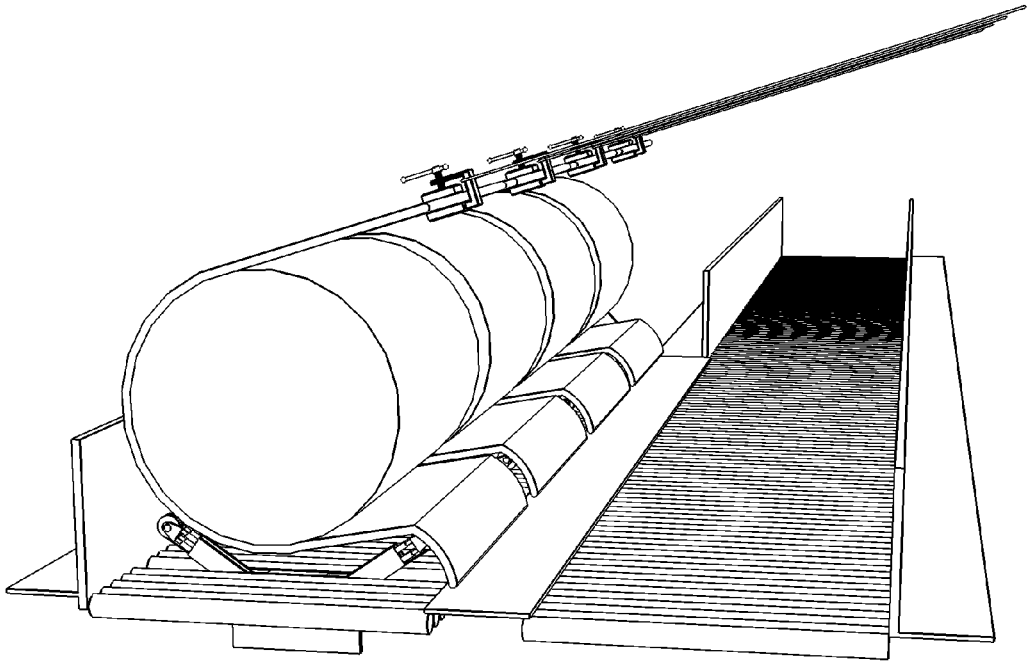
FIGS. 8A and 8B illustrate two perspective overviews of said one or more round modules, first in an open configuration with tilting module feeder in a non-inclined position and second in an inclined position, respectively.
Figure 8B:
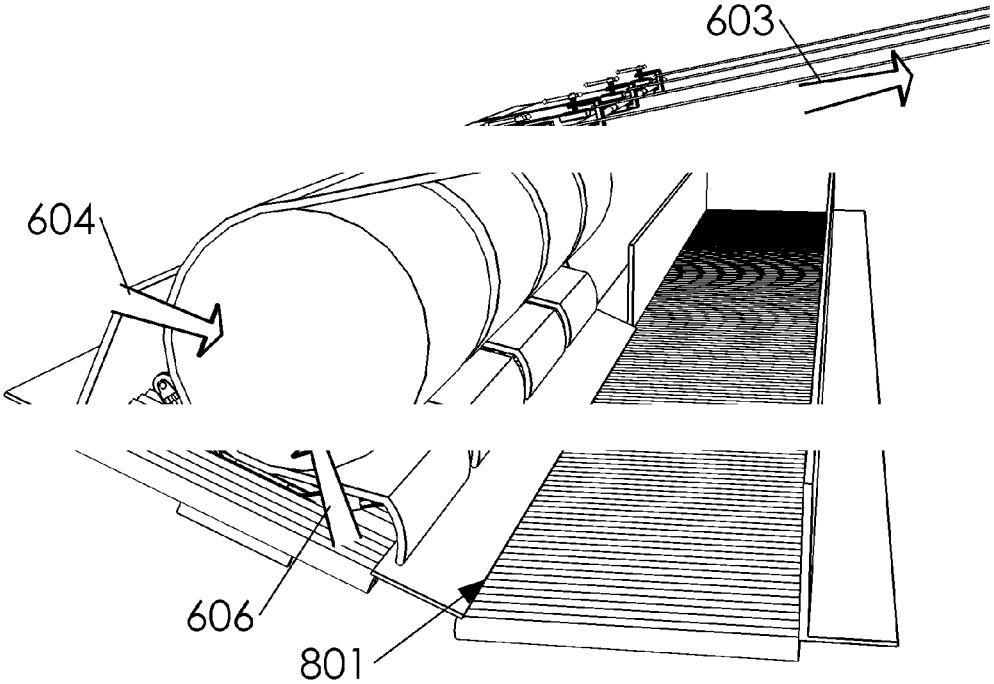

FIGS. 8A and 8B illustrate two perspective overviews of said one or more round modules, first in an open configuration with tilting module feeder 102 in a non-inclined position and second in an inclined position, respectively. Round module unwrapping system 100 can comprise said inclined position and a non-inclined position. In one embodiment, said non-inclined position can comprise titling module feeder 102 substantially parallel with primary module feeder 101, as shown in FIG. 8A. In one embodiment, said inclined position can comprise tilting module feeder 102 inclined; wherein a shared edge 801 between titling module feeder 102 and primary module feeder 101 substantially comprises a pivot point for tilting module feeder 102, as shown in FIG. 8B. In one embodiment, round module unwrapping system 100 can comprise a second titling module feeder; wherein, said second titling module feeder is aligned along second side 113 of primary module feeder 101; titling module feeder 102 and said second titling module feeder each comprise an external side and an internal edge; and, said inclined position comprises said external edges lifting in order to roll objects thereupon onto said primary module feeder 101.

In one embodiment, packed fibrous material 203 can be released from within round module 201 while in said inclined position. For example, in one embodiment, packed fibrous material 203 can be unwrapped from module wrapper 202 by a round module unwrapping method; wherein said round module unwrapping method comprises loading one or more round module 201 on titling module feeder 102, detaching first flap 211 from second flap 212, attaching pulling assembly 601 to second flap 212, tilting titling module feeder 102 while holding round module 201 on titling module feeder 102 with said module rotator 105*a*, pulling second flap 212 with pulling force 603 while releasing round module 201 with said module rotator 105*a*, and rolling packed fibrous material 203 onto primary module feeder 101. In one embodiment, holding round module 201 with said module rotator 105*a* comprises lifting one of said one or more actuating arms capable of buttressing a portion of round module 201 on titling module feeder 102. Likewise, releasing round module 201 with said module rotator 105*a* comprises lowering said one or more actuating arms. In one embodiment, packed fibrous material 203 can be retained on round module unwrapping system while rolling from titling module feeder 102 to primary module feeder 101 with wind boards 103 by blocking packed fibrous material 203 from rolling off of primary module feeder 101 at second side 113.

Figure 9:
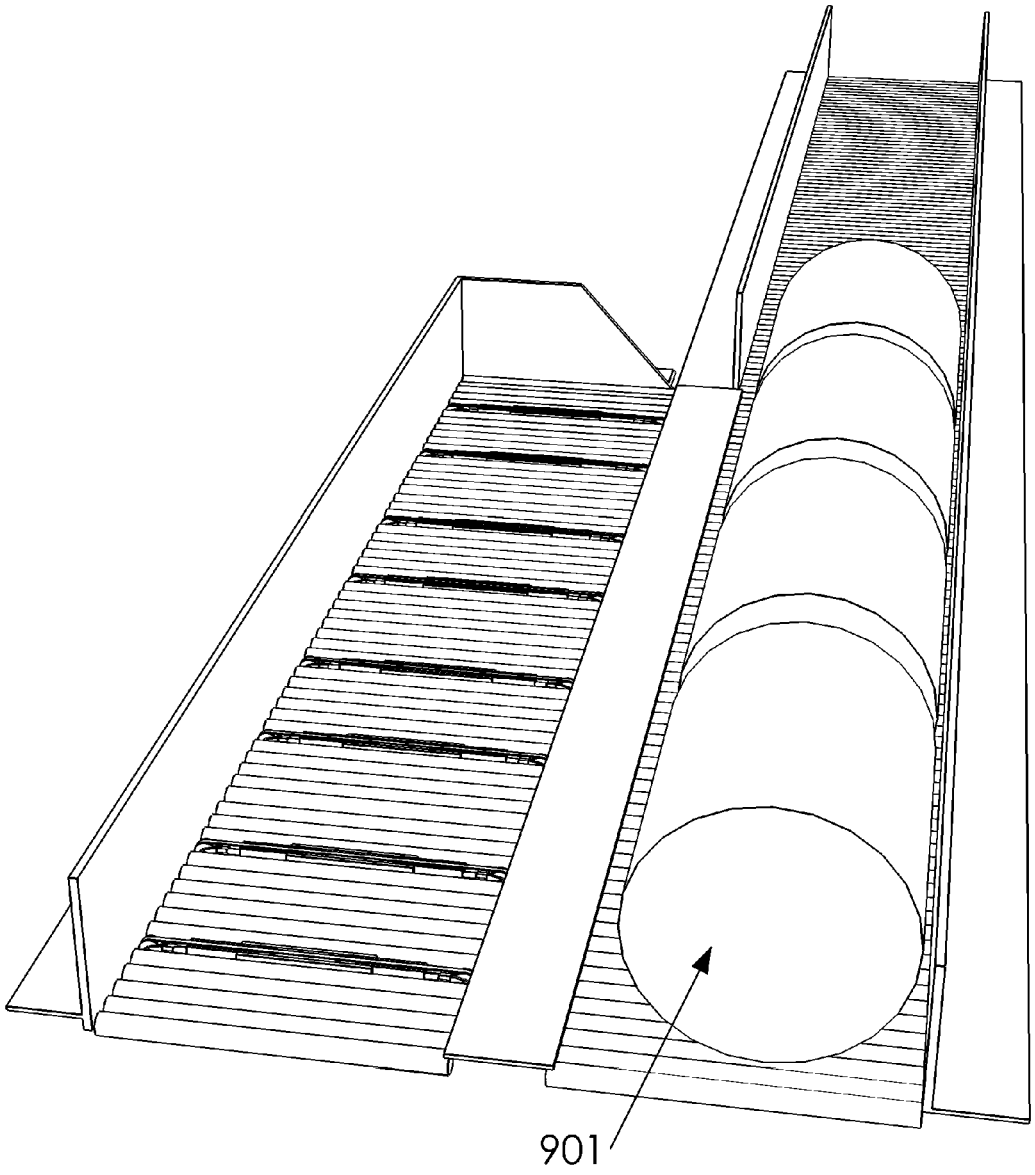
FIG. 9 illustrates a plurality of unwrapped modules 901 on primary module feeder.

FIG. 9 illustrates a plurality of unwrapped modules 901 on primary module feeder 101. Unwrapped modules 901 can comprise packed fibrous material 203 formerly within module wrapper 202, now unwrapped. In one embodiment, unwrapped modules 901 can be transported to second end 111 for processing by conveying said unwrapped modules 901 down primary module feeder 101 toward second end 111. Round module unwrapping system 100 can now be reset by lowering tilting module feeder 102 from said inclined position to said non-inclined position and/or removing said module wrapper 202 from said pulling assembly 601.

Figure 10A:
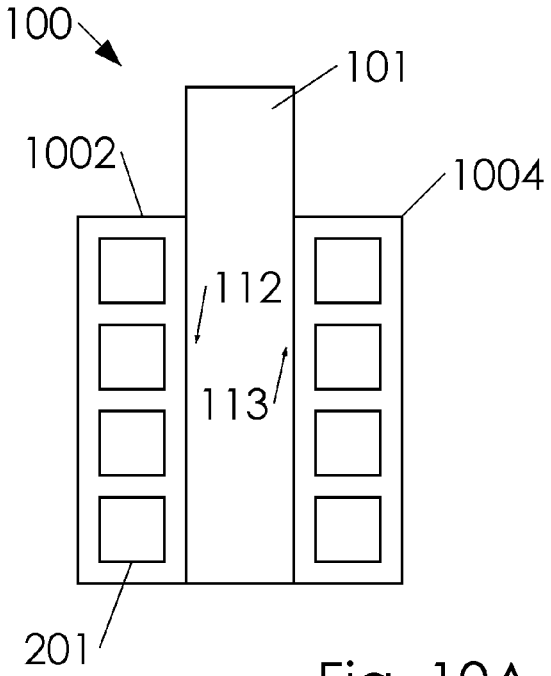
FIGS. 10A and 10B illustrate an elevated top view of two variations on said round module unwrapping system.
Figure 10B:
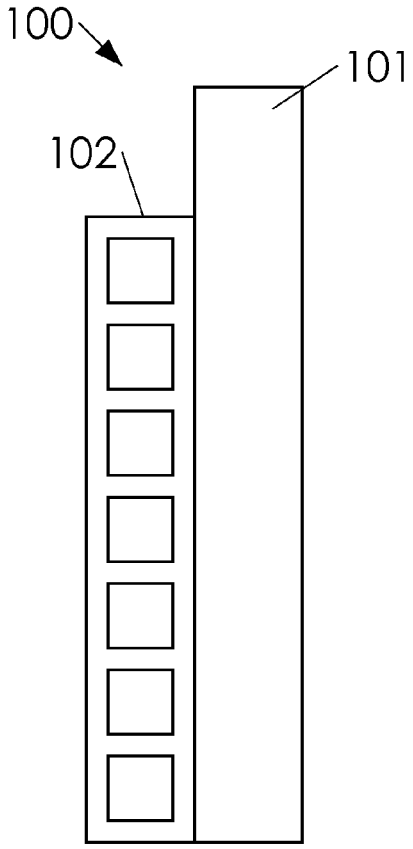

FIGS. 10A and 10B illustrate an elevated top view of two variations on said round module unwrapping system 100. In one embodiment, said round module unwrapping system 100 can comprise two of said one or more titling module feeders (comprising a first titling module feeder 1002 and a second titling module feeder 1004; wherein, said first titling module feeder 1002 can be aligned at said first side 112 of said primary module feeder 101 and said second titling module feeder 1004 can be aligned at said second side 113 of said primary module feeder 101 (as illustrated in FIG. 10A). In another embodiment, said round module unwrapping system 100 can comprise said titling module feeder 102 and said primary module feeder 101 (as described in FIG. 1), however, said titling module feeder 102 and said primary module feeder 101 can be elongated to accommodate more than one of said one or more round modules (as illustrated in FIG. 10B).

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A round module unwrapping system comprising:

said round module unwrapping system comprising two or more module feeder floors;

said round module unwrapping system is configured for supporting one or more round modules each having a module wrapper enclosing a packed fibrous material;

said two or more module feeder floors comprise a primary module feeder and one or more titling module feeders;

said one or more titling module feeders comprise a non-inclined position and an inclined position;

said non-inclined position comprises said one or more titling module feeders substantially parallel with said primary module feeder;

said inclined position comprises a first side of said one or more titling module feeders raised higher than a second side;

said second side of said one or more titling module feeders is aligned next to said primary module feeder;

said round module unwrapping system having a first side and a second side;

said module wrapper of said one or more round modules each having a first flap, said second flap, an inside surface, and an outside surface;

said module wrapper of said one or more round modules each are wrapped around said packed fibrous material with said first flap releaseably attaching to said second flap;

said round module unwrapping system comprising further comprising a pulling assembly having a flap clasping portion;

said pulling assembly configured for selectively attaching to said second flap each of said module wrappers with a flap clasping portion;

a pulling assembly configured for pulling said second flap apart from said first flap of each of said module wrappers;

said one or more round modules having a first side, a second side, a front, a back, a top, and a bottom;

said two or more module feeder floors comprises a conveyor configured for moving said one or more round modules between a first end and a second end of said round module unwrapping system;

said flap clasping portion comprises a hook-and-loop clasping device;

said hook-and-loop clasping device comprises a body being either a hook portion or a loop portion;

said hook-and-loop clasping device is configured for removing said module wrapper of said one or more round modules; and said second flap of said module wrapper from said one among said one or more round modules comprises either a hook portion or a loop portion being dissimilar to said body of said hook-and-loop clasping device, said second flap selectively attaches said hook-and-loop clasping device by being pressed together.

2. The round module unwrapping system of claim 1 wherein said pulling assembly further comprises a line;

said flap clasping portion comprises a line receiving portion;

said line is configured for attaching to said line receiving portion; and wherein said pulling assembly is configured for removing said module wrapper of said one or more round modules by attaching said flap clasping portion to said module wrapper, attaching said line to said line receiving portion of said flap clasping device, asserting a pulling force upon said line, and removing said module wrapper.

3. The round module unwrapping system of claim 1 wherein said first flap and said second flap of said module wrapper are formed by cutting said module wrapper from said first side to said second side of each of said one or more round modules.

4. The round module unwrapping system of claim 1 wherein said conveyor of said two or more module feeder floors comprises a roller bed.

5. The round module unwrapping system of claim 1 wherein, said one or more titling module feeders comprise a first tilting module feeder;

said round module unwrapping system further comprises an intermediate module unwrapper catwalk between said first tilting module feeder and said primary module feeder.

6. The round module unwrapping system of claim 1 further comprising said one or more tilting module feeders further comprise one or more module rotators;

said one or more module rotators each having one or more actuating arms; wherein, said one or more module rotators are attached below a floor level of said one or more titling module feeders, said one or more module rotators each comprise a body having a first side and a second side, said one or more actuating arms each comprise an arm hinges, said one or more actuating arms each attach to said body with said arm hinges, said one or more actuating arms are configured for pivoting on said arm hinges, said one or more actuating arms are configured for buttressing and releasing a portion of said one or more round modules on said one or more titling module feeders, said one or more module rotators comprise a non-use position and an in-use position, said non-use position comprises all portions of said one or more module rotators stored below said floor level of said two or more module feeder floors, and said in-use position comprises a portion of said one or more actuating arms rotated above said floor level of said two or more module feeder floors; further wherein, buttressing a portion of said one or more round modules comprises transitioning said one or more module rotators from said non-use position to said in-use position by pivoting said one or more actuating arms above said floor level of said one or more titling module feeders and holding a portion of each round module with said one or more module rotators; and, releasing a portion of said one or more round modules comprises transitioning said one or more module rotators from said in-use position to said non-use position by pivoting said one or more actuating arms below said floor level of said one or more titling module feeder.

7. The round module unwrapping system of claim 6 wherein said one or more module rotators each comprise a belt driveshaft and a belt, said actuating arms comprise a first arm and a second arm, said actuating arms each comprise a first end and a second end, said actuating arms each comprise an internal portion, a pulley assembly and an accumulator assembly, and said pulley assemblies each comprise a wheel, an axle, and one or more side portions; further wherein, said first arm attaches to said first side of said body with one of said arm hinges;

said second arm attaches to said second side of said body with one of said arm hinges;

said actuating arms comprise an axis at said arm hinges;

each of said internal portions of said actuating arms connect said body to said accumulator assemblies;

each of said accumulator assemblies connect said internal portions to said pulley assemblies;

each of said pulley assemblies attach at said second end of said actuating arms;

said belt can attach to said module rotator around a multi-point loop;

said multi-point loop comprises a wheel of a first pulley assembly, a wheel of a second pulley assembly, and said belt driveshaft;

said accumulator assemblies can press said pulley assemblies apart from said internal portions of said actuating arms;

said belt can rotate around said multi-point loop; and said belt can be kept tight around said multi-point loop by pressing said pulley assemblies apart from one another with said accumulator assemblies.

8. The round module unwrapping system of claim 7 wherein each of said accumulator assemblies each comprise one or more accumulators each having a cylinder and a floating rod; further wherein, said cylinders comprise a pressure storage reservoir comprising a pressurized fluid which is configured for being held under pressure, and said floating rods are pressed outward, away from said cylinders, by said pressure in said pressure storage reservoir.

9. The round module unwrapping system of claim 1 further comprising one or more wind boards configured for blocking wind and creating a retaining wall around said round module unwrapping system; wherein, said wind boards align around one or more external edges of said round module unwrapping system.

10. A round module unwrapping method comprising:

supporting at least one of a one or more round modules on a module feeder floor of a round module unwrapping system, detaching a first flap from a second flap of a module wrapper of said at least one of said one or more round modules, and pulling said second flap of said module wrapper; wherein, said round module unwrapping system comprising two or more module feeder floors;

said round module unwrapping system is configured for supporting said at least one of said one or more round modules each having a module wrapper enclosing a packed fibrous material;

said two or more module feeder floors comprise a primary module feeder and one or more titling module feeders;

said one or more titling module feeders comprise a non-inclined position and an inclined position;

said non-inclined position comprises said one or more titling module feeders substantially parallel with said primary module feeder;

said inclined position comprises a first side of said one or more titling module feeders raised higher than a second side;

said second side of said one or more titling module feeders is aligned next to said primary module feeder;

said round module unwrapping system having a first side and a second side;

said module wrapper of said one or more round modules each having a first flap, said second flap, an inside surface, and an outside surface;

said module wrapper of said one or more round modules each are wrapped around said packed fibrous material with said first flap releaseably attaching to said second flap;

said round module unwrapping system comprising further comprising a pulling assembly having a flap clasping portion;

said pulling assembly configured for selectively attaching to said second flap each of said module wrappers with a flap clasping portion;

a pulling assembly configured for pulling said second flap apart from said first flap of each of said module wrappers;

said one or more round modules having a first side, a second side, a front, a back, a top, and a bottom;

said two or more module feeder floors comprises a conveyor configured for moving said one or more round modules between a first end and a second end of said round module unwrapping system;

said flap clasping portion comprises a hook-and-loop clasping device;

said hook-and-loop clasping device comprises a body being either a hook portion or a loop portion;

said hook-and-loop clasping device is configured for removing said module wrapper of said one or more round modules; and said second flap of said module wrapper from said one among said one or more round modules comprises either a hook portion or a loop portion being dissimilar to said body of said hook-and-loop clasping device, said second flap selectively attaches said hook-and-loop clasping device by being pressed together.

11. The round module unwrapping method of claim 10 wherein pulling said second flap of said module wrapper comprises attaching a pulling assembly to said second flap with a flap clasping device, and applying a pulling force to said pulling assembly and thereby separating said module wrapper from said packed fibrous material.

12. The round module unwrapping method of claim 11 wherein attaching a pulling assembly to said second flap with a flap clasping device comprises pressing a first paddle against a second paddle of a clamp with said second flap between said first paddle and said second paddle by rotating a threaded shaft with a turning assembly, adjusting a position of said threaded shaft within a threaded hole, and moving said first paddle toward said second paddle; further wherein, said flap clasping portion comprises said first paddle, said second paddle, a connecting bracket, and a pressing assembly; further wherein, said connecting bracket comprises a U-shaped member having a first portion attached to a second portion, a third portion attached to said second portion, and said first portion and said third portion substantially parallel to one another;

said second paddle attaches to said third portion;

said first portion of said connecting bracket comprises said threaded hole;

said pressing assembly comprises a threaded shaft and said turning assembly;

said turning assembly attaches to a first end of said threaded shaft;

said threaded shaft is inserted through said threaded hole; and, said first paddle attaches at a second end of said threaded shaft.

13. The round module unwrapping method of claim 12 wherein attaching a pulling assembly to said second flap with a flap clasping device comprises pressing a first portion of a hook-and-loop fastener against a second portion of a hook-and-loop fastener on said second flap of said module wrapper; further wherein, said flap clasping portion comprises said hook-and-loop clasping device;

said hook-and-loop clasping device comprises said body having said first portion of a hook-and-loop fastener; and, said second flap of said module wrapper comprises said second portion of said hook and loop fastener.

14. The round module unwrapping method of claim 10 further comprising:

lifting a titling module feeder into an inclined position while buttressing at least a first round module of said one or more round modules on said titling module feeder prior to pulling said second flap; and releasing at least a first round module of said one or more round modules with said one or more module rotators and rolling said packed fibrous material onto a primary module feeder after pulling said second flap; wherein, said first side of at least a first round module of said one or more round modules unwrapping system comprises said titling module feeder having a first end, a second end, a first side, a second side and a tilting module feeder floor, said second side of at least a first round module of said one or more round modules unwrapping system comprises said primary module feeder having a first end, a second end, a first side, a second side, and a primary module feeder floor, said second side of said titling module feeder aligns next to said first side of said primary module feeder, said titling module feeder comprises said non-inclined position and an inclined position, said non-inclined position comprises said one or more tilting module feeder floor substantially parallel with said primary module feeder floor, and said inclined position comprises tilting said titling module feeder by lifting said first side of said titling module feeder independently from said second side of said titling module feeder.

15. The round module unwrapping method of claim 12 wherein buttressing said one or more round modules on said titling module feeder comprises transitioning one or more module rotators from a non-use position to an in-use position by pivoting one of one or more actuating arms above a floor level of said titling module feeder and holding a portion of each round module with said one or more module rotators; and, releasing at least a first round module of said one or more round modules with said one or more module rotators comprises transitioning said one or more module rotators from said in-use position to said non-use position by pivoting said actuating arms below said floor level of said titling module feeder; further wherein, said one or more module rotators each comprise said one or more actuating arms said one or more module rotators are attached below a floor level of said titling module feeder said one or more module rotators each comprise a body having a first side and a second side said one or more actuating arms each comprise an arm hinges said actuating arms each attach to said body with said arm hinges said actuating arms are configured for pivoting on said arm hinges said one or more actuating arms are configured for buttressing and releasing at least a first round module of said one or more round modules on said titling module feeder in said inclined position said one or more module rotators comprise a non-use position to an in-use position said non-use position comprises all portions of said one or more module rotators stored below said floor level of said two or more module feeder floors and said in-use position comprises a portion of said actuating arms rotated above said floor level of said two or more module feeder floors; further wherein.

16. The round module unwrapping method of claim 15 further comprising the step of aligning said one or more round modules into an aligned orientation prior to detaching said first flap from said second flap, by loading each of said one or more round modules over said one or more module rotators, lifting each of said one or more round modules above said two or more module feeder floors with said one or more module rotators, rotating each of said one or more round modules on said one or more module rotators until said one or more round modules are in said aligned orientation; wherein, said aligned orientation of said one or more round modules comprises said one or more round modules on said first side of said round module unwrapping system and each of said one or more round modules oriented about said module axis with said first flap and said second flap facing said second side of said round module unwrapping system.

17. The round module unwrapping method of claim 16 wherein lifting each of said one or more round modules above said two or more module feeder floors with said one or more module rotators comprises transitioning said actuating arms of said one or more module rotators into said in-use position, and rotating each of said one or more round modules with said one or more module rotators until said one or more round modules are in said aligned orientation comprise rotating said one or more round modules on a belt of each of said one or more module rotators and thereby rotating each of said one or more round modules about a module axis until each of round modules are at said aligned orientation; further wherein said one or more module rotators each comprise a belt driveshaft and said belt, said actuating arms comprise a first arm and a second arm, said actuating arms each comprise a first end and a second end, said actuating arms each comprise a internal portion, a pulley assembly and an accumulator assembly, said pulley assemblies each comprise a wheel, an axle, and one or more side portions, and said first arm attaches to said first side of said body with one of said arm hinges;

said second arm attaches to said second side of said body with one of said arm hinges;

said actuating arms comprise an axis at said arm hinges;

each of said internal portions of said actuating arms connect said body to said accumulator assemblies;

each of said accumulator assemblies connect said internal portions to said pulley assemblies;

each of said pulley assemblies attach at said second end of said actuating arms;

said belt can attach to said module rotator around a multi-point loop;

said multi-point loop comprises a wheel of a first pulley assembly, a wheel of a second pulley assembly, and said belt driveshaft;

said accumulator assemblies can press said pulley assemblies apart from said internal portions of said actuating arms;

said belt can rotate around said multi-point loop; and said belt can be kept tight around said multi-point loop by pressing said pulley assemblies apart from one another with said accumulator assemblies.

18. The round module unwrapping method of claim 10 wherein detaching a first flap from a second flap of a module wrapper of said one or more round modules comprises breaking a flap attachment between said first flap and said second flap; wherein, said flap attachment on said module wrapper comprises a hook-and-loop fastener;

said hook-and-loop fastener comprises a first portion and a second portion;

said first portion of said hook-and-loop fastener attaches to said inside surface of said module wrapper at said first flap;

said second portion of said hook-and-loop fastener attaches to said outside surface of said module wrapper at said second flap;

said first flap attaches to said second flap by attaching said first portion to said second portion of said hook-and-loop fasteners;

said first flap detaches from said second flap by detaching said first portion from said second portion of said hook-and-loop fasteners; and breaking said flap attachment comprises detaching said first portion and said second portion of said hook-and-loop fasteners.

19. A round module unwrapping system comprising:

said round module unwrapping system comprising two or more module feeder floors;

said round module unwrapping system is configured for supporting one or more round modules each having a module wrapper enclosing a packed fibrous material;

said two or more module feeder floors comprise a primary module feeder and one or more titling module feeders;

said one or more titling module feeders comprise a non-inclined position and an inclined position;

said non-inclined position comprises said one or more titling module feeders substantially parallel with said primary module feeder;

said inclined position comprises a first side of said one or more titling module feeders raised higher than a second side;

said second side of said one or more titling module feeders is aligned next to said primary module feeder;

said round module unwrapping system having a first side and a second side;

said module wrapper of said one or more round modules each having a first flap, said second flap, an inside surface, and an outside surface;

said module wrapper of said one or more round modules each are wrapped around said packed fibrous material with said first flap releaseably attaching to said second flap;

said round module unwrapping system comprising further comprising a pulling assembly having a flap clasping portion;

said pulling assembly configured for selectively attaching to said second flap each of said module wrappers with a flap clasping portion;

a pulling assembly configured for pulling said second flap apart from said first flap of each of said module wrappers;

said one or more round modules having a first side, a second side, a front, a back, a top, and a bottom;

said two or more module feeder floors comprises a conveyor configured for moving said one or more round modules between a first end and a second end of said round module unwrapping system;

said flap clasping portion comprises a first paddle, a second paddle, a connecting bracket, and a pressing assembly; further wherein, said connecting bracket comprises a U-shaped member having a first portion attached to a second portion, a third portion attached to said second portion, and said first portion and said third portion substantially parallel to one another;

said second paddle attaches to said third portion;

said first portion of said connecting bracket comprises a threaded hole;

said pressing assembly comprises a threaded shaft and a turning assembly;

said turning assembly attaches to a first end of said threaded shaft;

said threaded shaft is inserted through said threaded hole;

said first paddle attaches at a second end of said threaded shaft; and, said pressing assembly is configured for pressing said first paddle toward said second paddle by rotating said threaded shaft with said turning assembly, adjusting a position of said threaded shaft within said threaded hole, and moving said first paddle toward said second paddle.

20. A round module unwrapping system comprising:

said round module unwrapping system comprising two or more module feeder floors;

said round module unwrapping system is configured for supporting one or more round modules each having a module wrapper enclosing a packed fibrous material;

said two or more module feeder floors comprise a primary module feeder and one or more titling module feeders;

said one or more titling module feeders comprise a non-inclined position and an inclined position;

said non-inclined position comprises said one or more titling module feeders substantially parallel with said primary module feeder;

said inclined position comprises a first side of said one or more titling module feeders raised higher than a second side;

said second side of said one or more titling module feeders is aligned next to said primary module feeder;

said round module unwrapping system having a first side and a second side;

said module wrapper of said one or more round modules each having a first flap, said second flap, an inside surface, and an outside surface;

said module wrapper of said one or more round modules each are wrapped around said packed fibrous material with said first flap releaseably attaching to said second flap;

said round module unwrapping system comprising further comprising a pulling assembly having a flap clasping portion;

said pulling assembly configured for selectively attaching to said second flap each of said module wrappers with a flap clasping portion;

a pulling assembly configured for pulling said second flap apart from said first flap of each of said module wrappers;

said one or more round modules having a first side, a second side, a front, a back, a top, and a bottom;

said two or more module feeder floors comprises a conveyor configured for moving said one or more round modules between a first end and a second end of said round module unwrapping system;

said one or more tilting module feeders further comprise one or more module rotators;

said one or more module rotators each having one or more actuating arms; wherein, said one or more module rotators are attached below a floor level of said one or more titling module feeders, said one or more module rotators each comprise a body having a first side and a second side, said one or more actuating arms each comprise an arm hinges, said one or more actuating arms each attach to said body with said arm hinges, said one or more actuating arms are configured for pivoting on said arm hinges, said one or more actuating arms are configured for buttressing and releasing a portion of said one or more round modules on said one or more titling module feeders, said one or more module rotators comprise a non-use position and an in-use position, said non-use position comprises all portions of said one or more module rotators stored below said floor level of said two or more module feeder floors, and said in-use position comprises a portion of said one or more actuating arms rotated above said floor level of said two or more module feeder floors; further wherein, buttressing a portion of said one or more round modules comprises transitioning said one or more module rotators from said non-use position to said in-use position by pivoting said one or more actuating arms above said floor level of said one or more titling module feeders and holding a portion of each round module with said one or more module rotators; and, releasing a portion of said one or more round modules comprises transitioning said one or more module rotators from said in-use position to said non-use position by pivoting said one or more actuating arms below said floor level of said one or more titling module feeder.

* * * * *